US009670700B2

(12) United States Patent
Hanaki et al.

(10) Patent No.: US 9,670,700 B2
(45) Date of Patent: Jun. 6, 2017

(54) DOOR LATCH SYSTEM FOR VEHICLE

(71) Applicant: MITSUI KINZOKU ACT CORPORATION, Yokohama-shi, Kanagawa (JP)

(72) Inventors: Naoki Hanaki, Yamato (JP); Kohei Yamashita, Yokohama (JP)

(73) Assignee: MITSUI KINZOKU ACT CORPORATION, Yokohama-shi (JP)

( * ) Notice: Subject to any disclaimer, the term of this patent is extended or adjusted under 35 U.S.C. 154(b) by 563 days.

(21) Appl. No.: 14/024,085

(22) Filed: Sep. 11, 2013

(65) Prior Publication Data

US 2014/0070549 A1 Mar. 13, 2014

(30) Foreign Application Priority Data

Sep. 13, 2012 (JP) ..... 2012-201108
Nov. 30, 2012 (JP) ..... 2012-263206

(51) Int. Cl.

| | |
|---|---|
| ***E05C 3/06*** | (2006.01) |
| ***E05B 81/06*** | (2014.01) |
| ***E05B 81/14*** | (2014.01) |
| ***E05B 81/20*** | (2014.01) |
| ***E05B 81/36*** | (2014.01) |
| ***E05B 81/38*** | (2014.01) |
| ***E05B 83/40*** | (2014.01) |
| *E05C 3/00* | (2006.01) |
| *E05B 81/00* | (2014.01) |

(52) U.S. Cl.

CPC ..... *E05B 81/06* (2013.01); *E05B 81/14* (2013.01); *E05B 81/20* (2013.01); *E05B 81/36* (2013.01); *E05B 81/38* (2013.01); *E05B 83/40* (2013.01); *E05B 81/00* (2013.01); *Y10T 292/108* (2015.04); *Y10T 292/1082* (2015.04)

(58) Field of Classification Search

CPC ..... E05B 81/06; E05B 81/00
USPC ..... 292/201
See application file for complete search history.

(56) References Cited

U.S. PATENT DOCUMENTS 4,968,074 A * 11/1990 Yamagishi ..... E05B 81/20 292/201
5,893,593 A * 4/1999 Dowling ..... E05B 77/26 292/169.11

(Continued)

FOREIGN PATENT DOCUMENTS

JP 2004-293038 A 10/2004

*Primary Examiner* — Carlos Lugo
(74) *Attorney, Agent, or Firm* — Foley & Lardner LLP

(57) ABSTRACT

A door latch system for a vehicle includes: a latch interlocking mechanism arranged to be actuated in a release cancel direction from a neutral position to be interlocked with the pivot movement of the latch in a predetermined direction; and a release cancel mechanism arranged to be actuated from a connection state where an operation force transmitting path for transmitting the power of the electric driving mechanism to the ratchet is connected, to a disconnection state where the operation force transmitting path is disconnected, by the actuation of the latch interlocking mechanism in the release cancel direction from the neutral position, the release cancel mechanism being arranged to be actuated from the connection state to the disconnection state when the ratchet is in a release restriction state so as to enable the ratchet to return to the engagement position.

16 Claims, 21 Drawing Sheets

(56) References Cited

U.S. PATENT DOCUMENTS

| | | | | |
|---|---|---|---|---|
| 6,715,806 | B2 * | 4/2004 | Arlt | E05B 81/06 292/201 |
| 6,932,393 | B2 * | 8/2005 | Erices | E05B 81/06 292/216 |
| 7,360,337 | B2 * | 4/2008 | Yoneyama | E05B 81/20 49/280 |
| 7,488,014 | B2 * | 2/2009 | Nozawa | E05B 81/06 292/201 |
| 8,061,742 | B2 * | 11/2011 | Machida | E05B 81/20 292/201 |
| 8,333,414 | B2 * | 12/2012 | Takayanagi | E05B 81/14 292/201 |
| 8,613,160 | B2 * | 12/2013 | Matsumoto | E05B 79/20 49/279 |
| 8,616,594 | B2 * | 12/2013 | Shimura | E05B 77/265 292/1 |
| 8,789,861 | B2 * | 7/2014 | Takayanagi | E05B 77/265 292/201 |
| 8,894,103 | B2 * | 11/2014 | Shibayama | E05B 83/40 292/201 |
| 8,967,680 | B2 * | 3/2015 | Yokomori | E05F 15/10 292/201 |
| 2013/0249222 | A1 * | 9/2013 | Yokomori | E05B 81/38 292/201 |

* cited by examiner

DOOR LATCH SYSTEM FOR VEHICLE

BACKGROUND OF THE INVENTION

This invention relates to a door latch system for a vehicle in which a latch mechanism is released by an electric driving mechanism so that a door can be opened and closed.

A Japanese Patent Application Publication No. 2004-293038 discloses a conventional door latch system for a vehicle which includes a latch mechanism that is arranged to be engaged with a striker provided to a vehicle body, and thereby to hold a door in a closed state, and an electric driving mechanism including a motor. In this door latch system, a pivot member is pivoted by a power of the electric driving mechanism, so that the latch mechanism is actuated to be released so that the door can be opened. However, in this door latch system, when the release actuation for opening the door is performed by the power of the driving source of the electric driving mechanism, the pivot member may be stopped at a position at which the release actuation is performed due to influence of trouble of an electric system and so on, so that there may be generated a release restriction state in which the latch mechanism is restricted in a state in which the release is actuated. After that, the door cannot be closed.

SUMMARY OF THE INVENTION

However, in the above-described door latch system for the vehicle, when the release restriction state is generated, the release restriction state can be canceled by handle operation of the occupant, so that the door can be closed. However, in a case where the occupant does not know the method of canceling the release restriction state, the occupant is forced to look through a manual of the vehicle and so on, so that the door cannot be rapidly closed.

It is, therefore, an object of the present invention to provide a door latch system for a vehicle devised to solve the above mentioned problems, and to cancel a release restriction state without a specific operation of the occupant.

According to one aspect of the present invention, a door latch system for a vehicle comprises: a latch which is provided to one of a door and a vehicle body, and which is arranged to be pivoted between a latch position at which the latch is engaged with a striker provided to the other of the door and the vehicle body when the door is at one of a door closed position and a door open position, and an open position at which the latch is released from the striker; a ratchet arranged to be moved between an engagement position at which the ratchet is engaged with the latch positioned at the latch position so as to restrict a pivot movement of the latch in an open direction, and a release position at which the ratchet is released from the latch so as to allow the pivot movement of the latch in the open direction; an electric driving mechanism arranged to output a power for moving the ratchet from the engagement position to the release position; a latch interlocking mechanism which is arranged to be actuated in a release cancel direction from a neutral position to be interlocked with the pivot movement of the latch in a predetermined direction; and a release cancel mechanism which is arranged to be actuated from a connection state where an operation force transmitting path for transmitting the power of the electric driving mechanism to the ratchet is connected, to a disconnection state where the operation force transmitting path is disconnected, by the actuation of the latch interlocking mechanism in the release cancel direction from the neutral position, the release cancel mechanism being arranged to be actuated from the connection state to the disconnection state when the ratchet is in a release restriction state where the ratchet is restricted to the release position so as to enable the ratchet to return to the engagement position.

DETAILED DESCRIPTION OF THE INVENTION

Hereinafter, door latch systems according to embodiments of the present invention will be illustrated with reference to the accompanying drawings.

Figure 1:
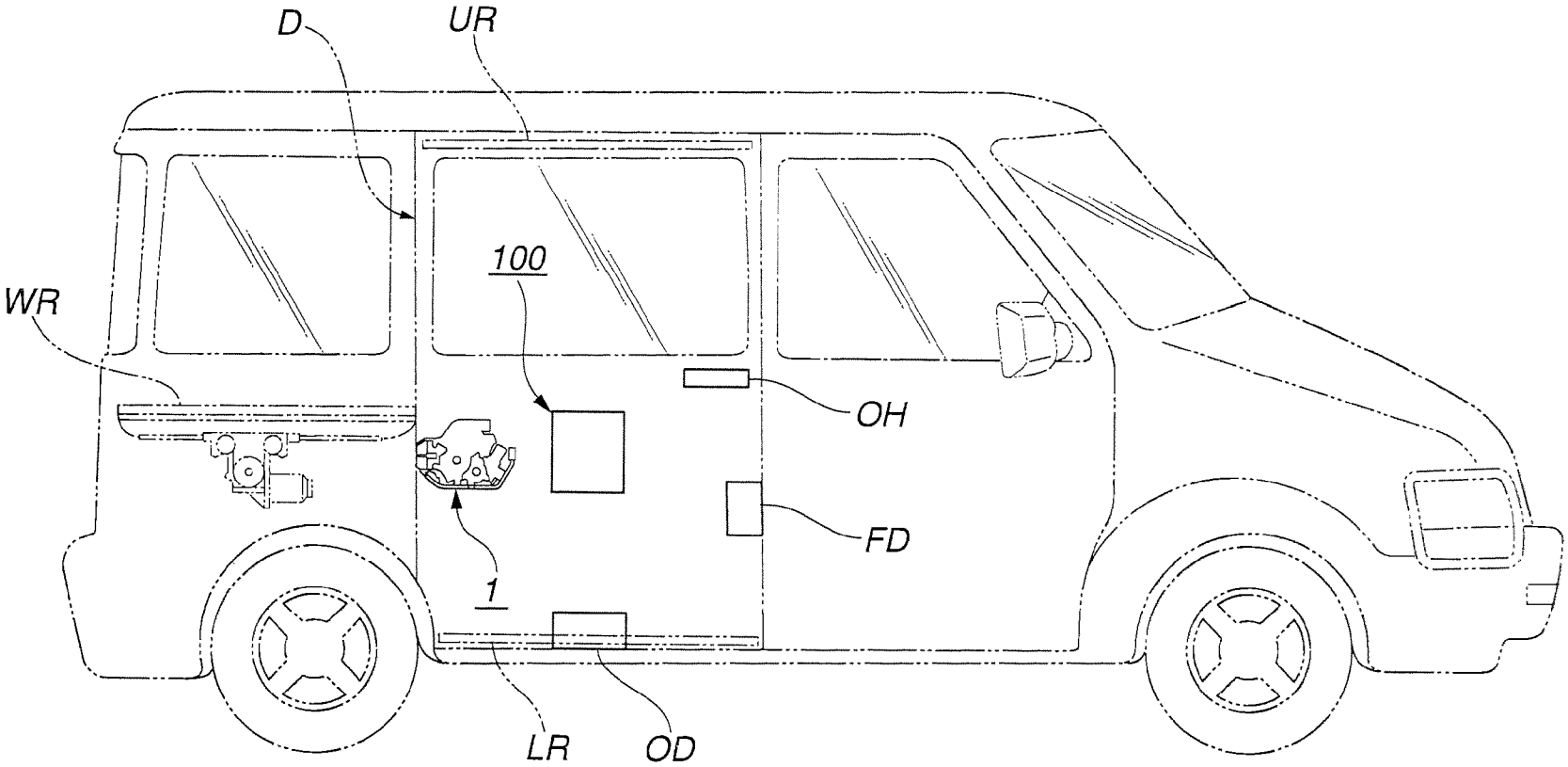
FIG. 1 is a schematic view showing a vehicle to which a door latch system according to a first embodiment of the present invention is applied.
Figure 2:
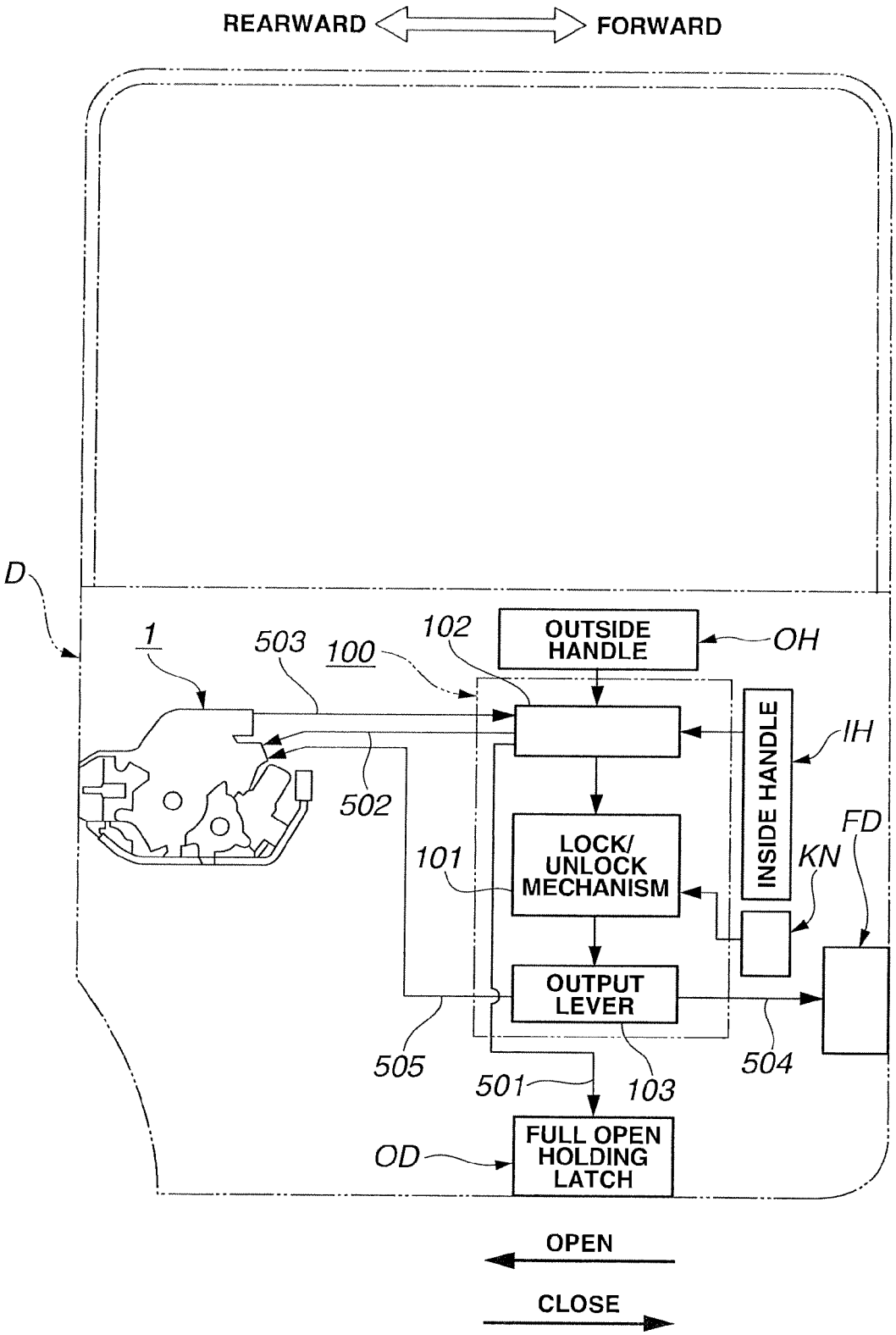
FIG. 2 is a schematic view showing a sliding door to which the door latch system according to the first embodiment of the present invention is applied.

In FIGS. 1 and 2, a symbol D is a sliding door (hereinafter, referred to as a door) which is supported by an upper guide rail UR, a waist guide rail WR, and a lower guide rail LR that are provided on a side surface of a vehicle body to extend in forward and rearward directions, and which is arranged to be opened and closed in the forward and rearward directions. A symbol OH is an outside handle which is disposed on an outside surface (outer panel) of the door D, and which is operated when the door D is opened and closed from an outside of the vehicle. A symbol IH is an inside handle which is disposed on an inner side surface of the door D, and which is operated when the door D is opened and closed from the inside of the vehicle. A symbol KN is a lock operation knob which is disposed on the door D on the inside of the vehicle, and which is operated when a lock/unlock mechanism 101 described later is manually operated to switch an lock state and a lock state. A symbol FD is a front door latch disposed at a front portion of the door D, and arranged to hold the door D in a closed position. A symbol OD is a full open latch which is disposed at a lower portion of the door D, and which is arranged to hold the door D at a full open position. A symbol 1 is a door latch which is disposed at a rear portion of the door D, and which is arranged to hold the door D at the closed position together with the front door latch FD. A symbol 100 is an operation relay device which is disposed within the door D, which relays the operation of the outside handle OH and the operation of the inside handle IH, and which transmits the relayed operation to the door latch 1, the front door latch FD, and the full open latch OD.

In the door latch system according to the embodiments of the present invention, the door latch 1 and the operation relay device 100 are provided to the door D. However, the present invention is not limited to the embodiments. The door latch 1 and the operation relay device 100 may be provided to the vehicle body. In this case, a striker S (described later) arranged to be engaged with the door latch 1 is provided to the door D.

The operation relay device 100 includes a lock/unlock mechanism 101 which includes a plurality of levers that are arranged to switch an unlock state to enable the operation of the outside handle OH and the operation of the inside handle IH so that an open operation of the door D can be performed, and a lock state to disable the operation of the outside handle OH and the operation of the inside handle IH so that the open operation of the door D cannot be performed, based on the lock operation and the unlock operation of the lock operation knob KN by the manual operation by the occupant, and an electric operation of a lock/unlock electric actuator (not shown); a handle interlocking lever 102 which is arranged to be constantly interlocked with the operation of the outside handle OH and the inside handle IH regardless of the state of the lock/unlock mechanism 101; and an output lever 103 which is arranged to be actuated based on the operation of the outside handle OH and the operation of the inside handle IH only when the lock/unlock mechanism 101 is in the unlock state.

The handle interlocking lever 102 is connected with the full open latch OD and the door latch 1 through operation force transmitting members 501, 502, and 503 which are constituted by a rod, Bowden cable, and so on. Moreover, the output lever 103 is connected to the front door latch FD and the door latch 1 through operation force transmitting members 504 and 505 which are constituted by a rod, Bowden cable and so on.

Figure 3:
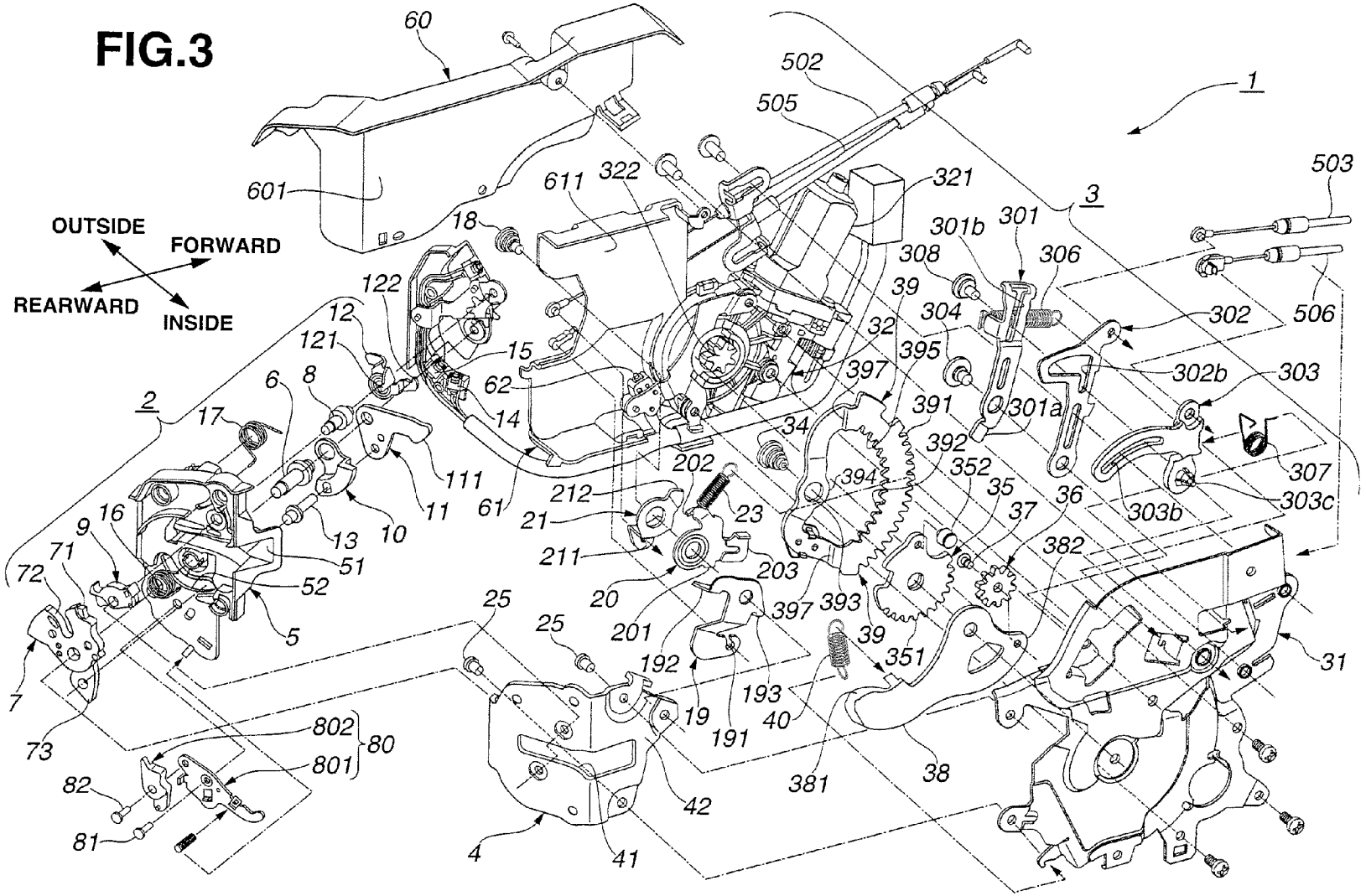
FIG. 3 is an exploded perspective view showing the door latch system as viewed from an inside of the vehicle.
Figure 4:
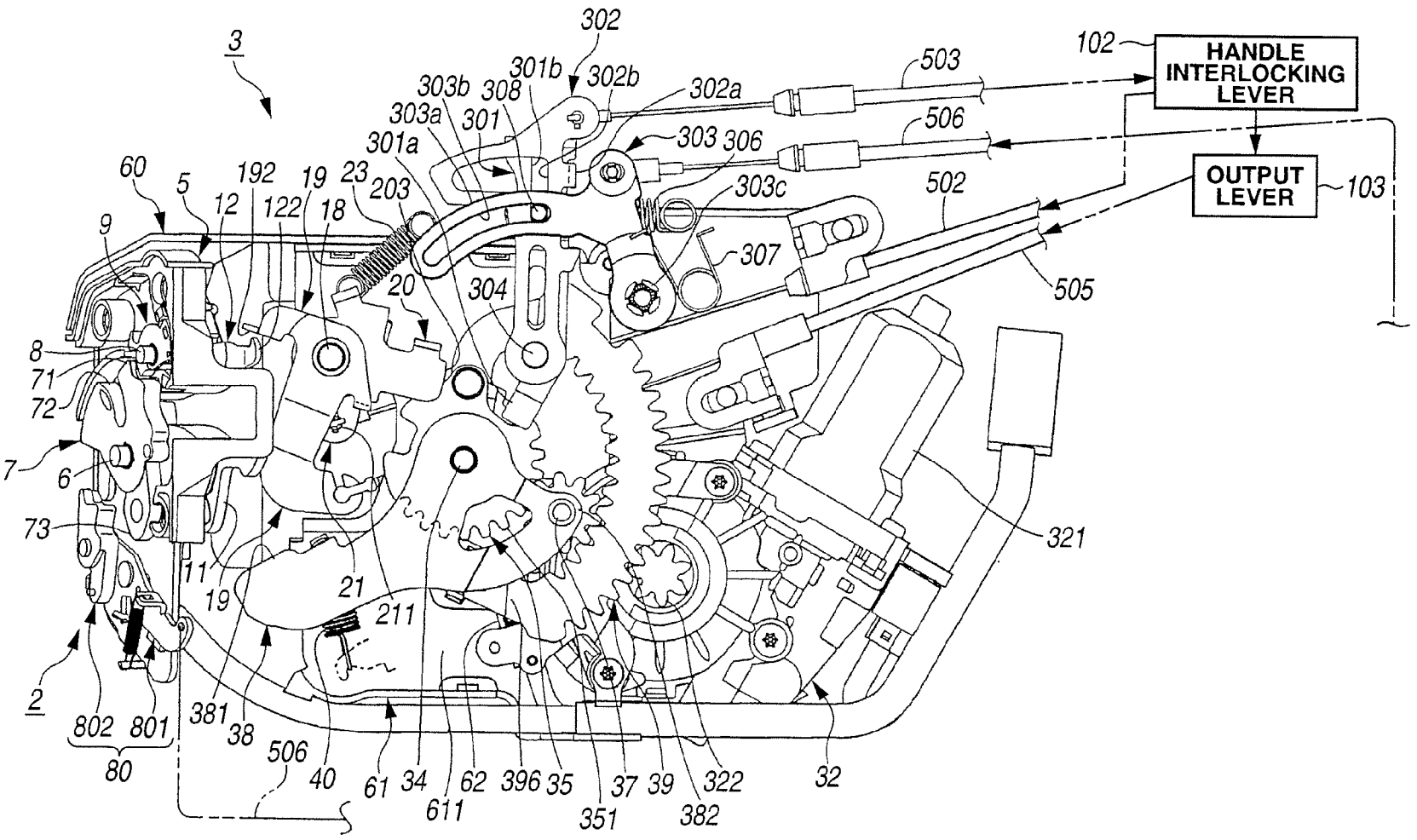
FIG. 4 is a front view showing an inside of the door latch system of FIG. 3 as viewed from the inside of the vehicle.

As shown in FIGS. 3 and 4, the door latch 1 includes a latch unit 2 which is arranged to be engaged with the striker S (cf. FIG. 7 and so on) fixed to the vehicle body, and thereby to restrict the door D in the closed position; and a closer/release unit 3 which has a close function which actuates the latch unit 2 from a half latch state to a full latch state at the closing operation of the door D so as to forcibly close the door D from the half latch state (half-shut state) to the full latch state (fully closed state), and a release function which releases the latch unit 2 in the engaged state in which the latch unit 2 is engaged with the striker S, from the striker S.

A top cover 60 made from a synthetic resin covers upper portions of the latch unit 2 and the closer/release unit 3 for keeping the rainwater, the dust and so on out. An under cover 61 made from the synthetic resin covers a lower portion of the closer/release unit 3 for keeping the rainwater, the dust and so on out. A side wall 601 of the top cover 60 and a side wall 611 of the under cover 61 cover a side surface of a planetary gear mechanism 33 (described later) of the closer/release unit 3 which directs the outside of the vehicle.

As shown in FIGS. 3-10, the latch unit 2 is provided with a housing 5 which is made from the synthetic resin, and which includes a mounting surface that is mounted to the door D, and that is closed by a cover plate 4 which is made from the metal, and which is formed into an L-shape in a planar view. The latch unit 2 includes a latch mechanism which includes a latch 7 received at a lower portion within the housing 5, and a ratchet 9 received on an upper side of the latch 7 within the housing 5. The latch 7 is pivotally supported by a latch shaft 6 extending in the forward and rearward directions, and arranged to be engaged with the striker S. The ratchet 9 is pivotally supported by a ratchet shaft 8 extending in the forward and rearward directions, and arranged to be selectively engaged with a full latch engagement portion 71 or a half latch engagement portion 72 which are formed on an outer circumference edge of the latch 7. Besides, in FIGS. 4-9, the cover plate 4 is omitted for showing an internal structure of the latch unit 2.

The cover plate 4 and the housing 5 of the latch unit 2 include, respectively, striker insertion holes 41 and 51 which extend in the inside and outside directions of the vehicle (in the lateral direction of the vehicle), and each of which includes an opening which is on the inside of the vehicle so that the striker S can enter from the inside of the vehicle when the door D is closed.

Figure 5:
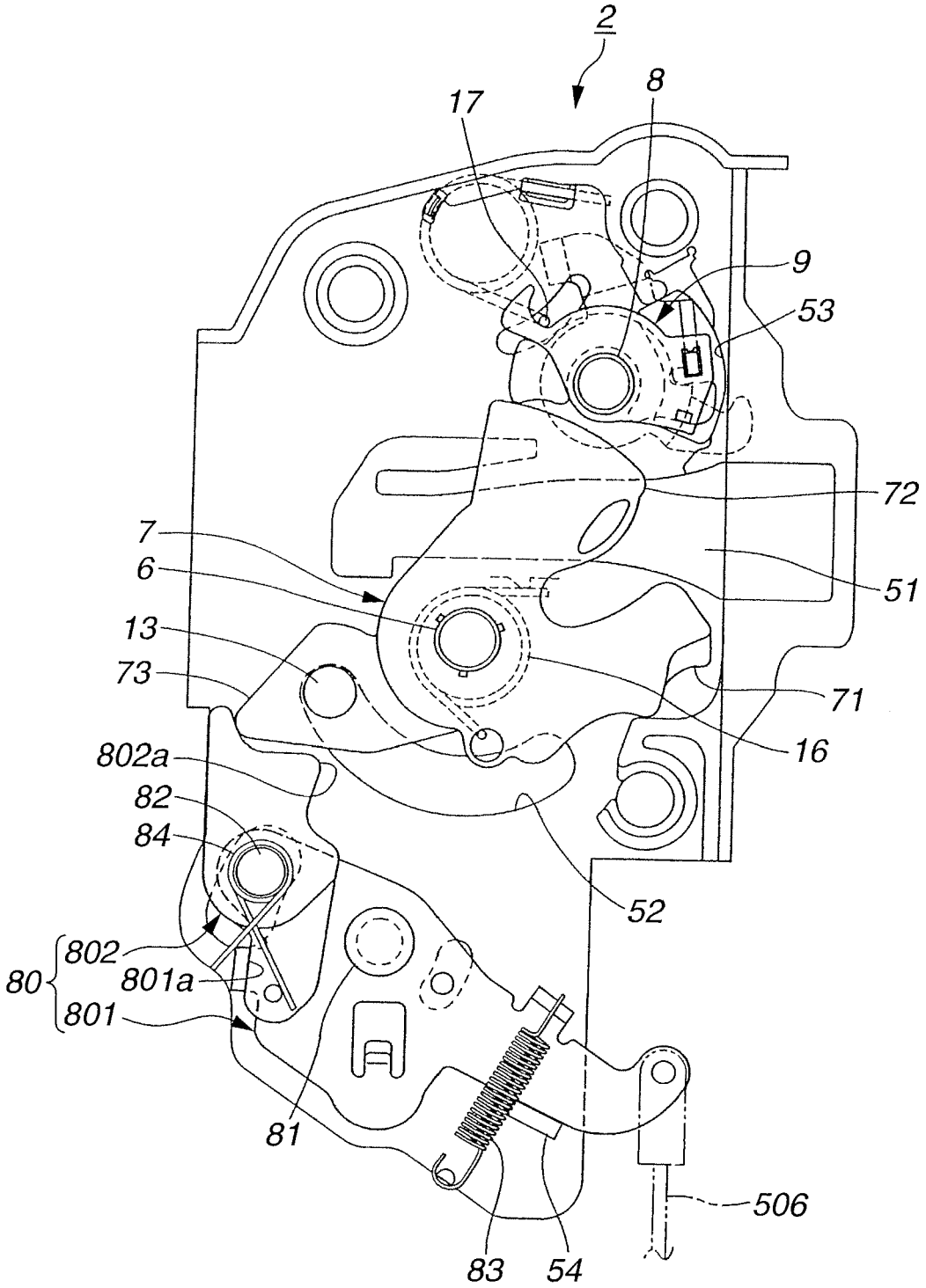
FIG. 5 is a side view showing an inside of a latch unit in an open state as viewed from a forward direction in the door latch system according to the first embodiment of the present invention.
Figure 7:
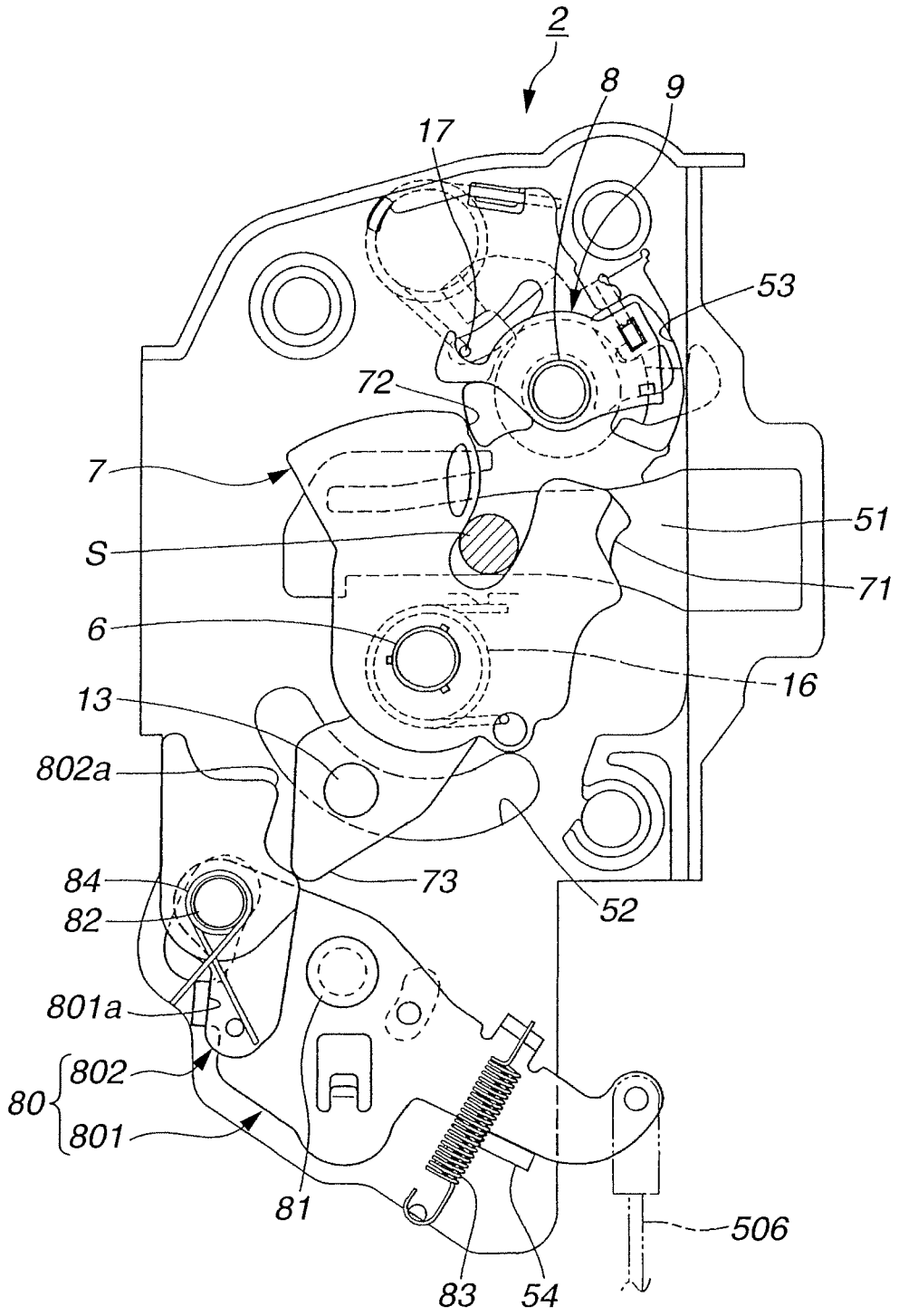
FIG. 7 is a side view showing the inside of the latch unit in a half latch state in the door latch system according to the first embodiment of the present invention.
Figure 8:
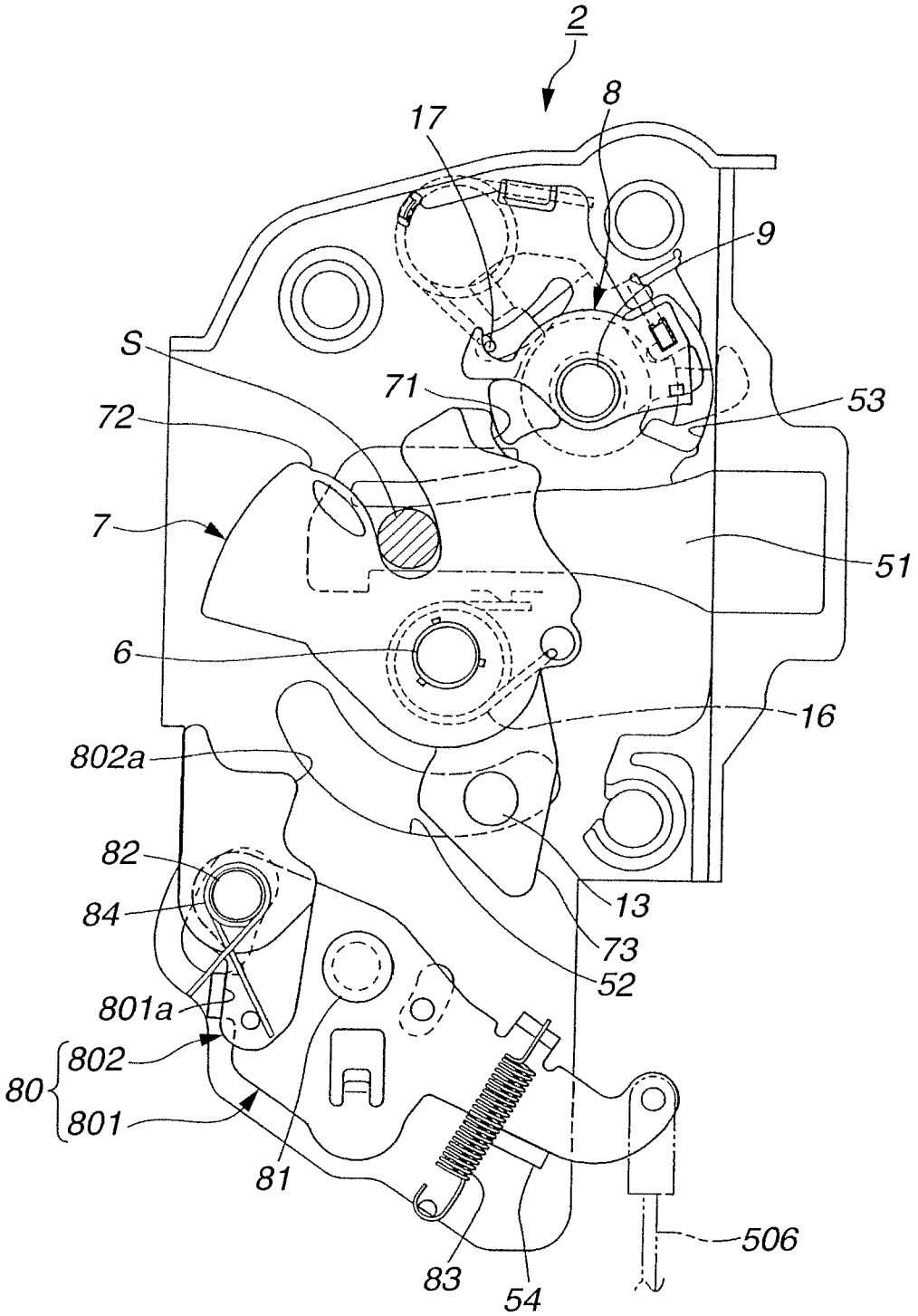
FIG. 8 is a side view showing the inside of the latch unit in the full latch state in the door latch system according to the first embodiment of the present invention.

The latch 7 is arranged to be pivoted in a closing direction (in a counterclockwise direction of FIG. 5) against an urging force of a spring 16 wound around the latch shaft 6, from an open position which is shown in FIG. 5, which corresponds to an open state of the door D, and at which the latch 7 is released (disengaged) from the striker S, through a half latch position which is shown in FIG. 7, and at which the latch 7 is slightly engaged with the striker S, to a full latch position which is shown in FIG. 8, and at which the latch 7 is fully engaged with the striker S. Hereinafter, "the open position", "the half latch position", and "the full latch position" of the latch 7 are represented as "an open state", "a half latch state", and "a full latch state" of the latch mechanism, if needed.

The latch 7 includes the full latch engagement portion 71, the half latch engagement portion 72, and an arm portion 73 extending in the radial direction. The arm portion 73 is arranged to actuate a latch interlocking mechanism 80 (described later) to perform a release cancel actuation at a predetermined pivot position of the latch 7 when the latch 7 is pivoted from the open position toward the full latch position, so that a release cancel lever 303 (described later) can perform a release cancel actuation.

Figure 10:
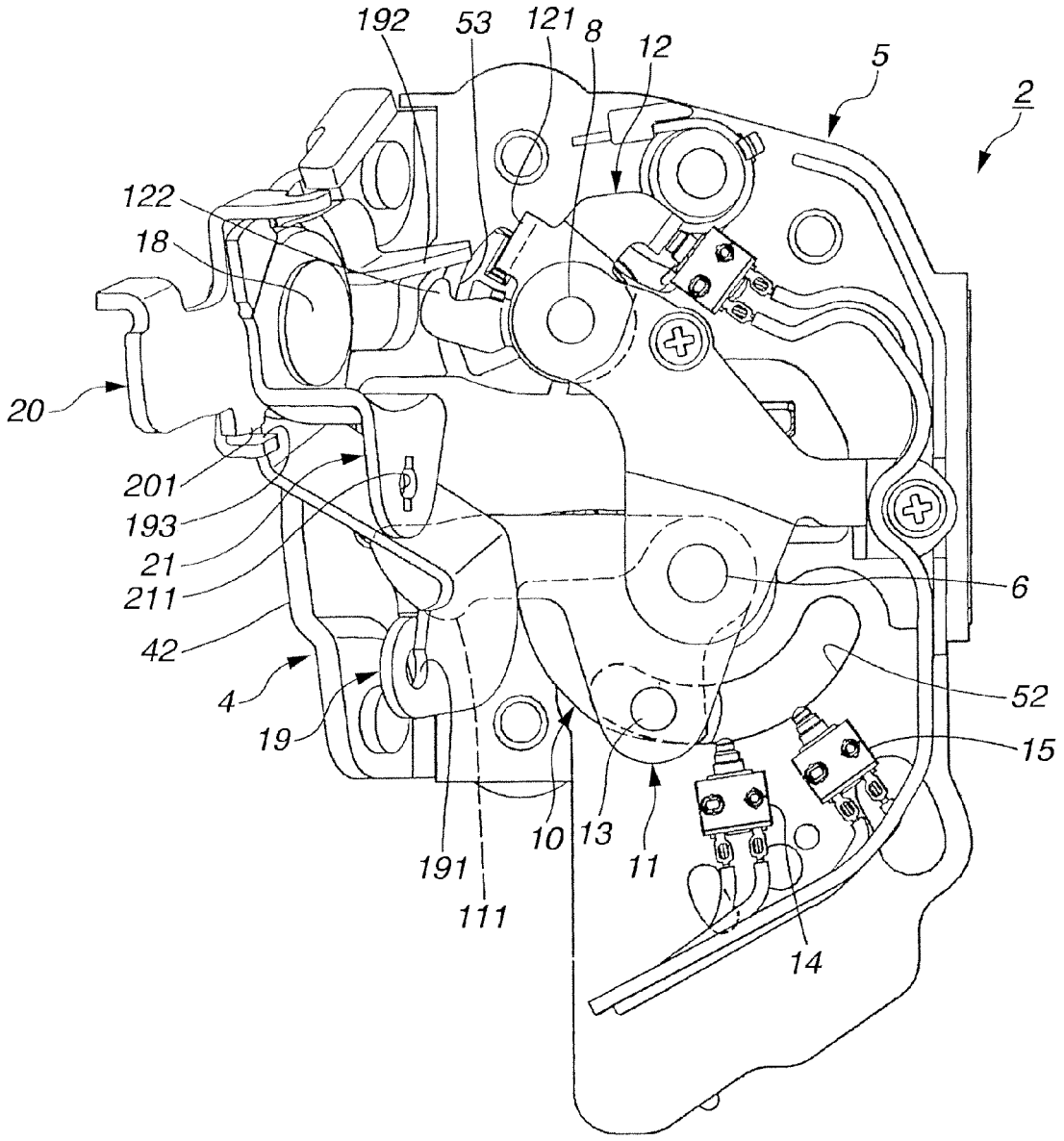
FIG. 10 is a side view when the latch unit is viewed from a rearward direction.

As shown in FIG. 10, a sensing lever 10, a latch lever 11 and an open lever 12 are disposed on a front surface side of the housing 5. The sensing lever 10 and the latch lever 11 are pivotally supported by the latch shaft 6, and arranged to be pivoted as a unit with the latch 7. The open lever 12 is pivotally supported by the ratchet shaft 8, and arranged to be pivoted as a unit with the ratchet 9.

Figure 11:
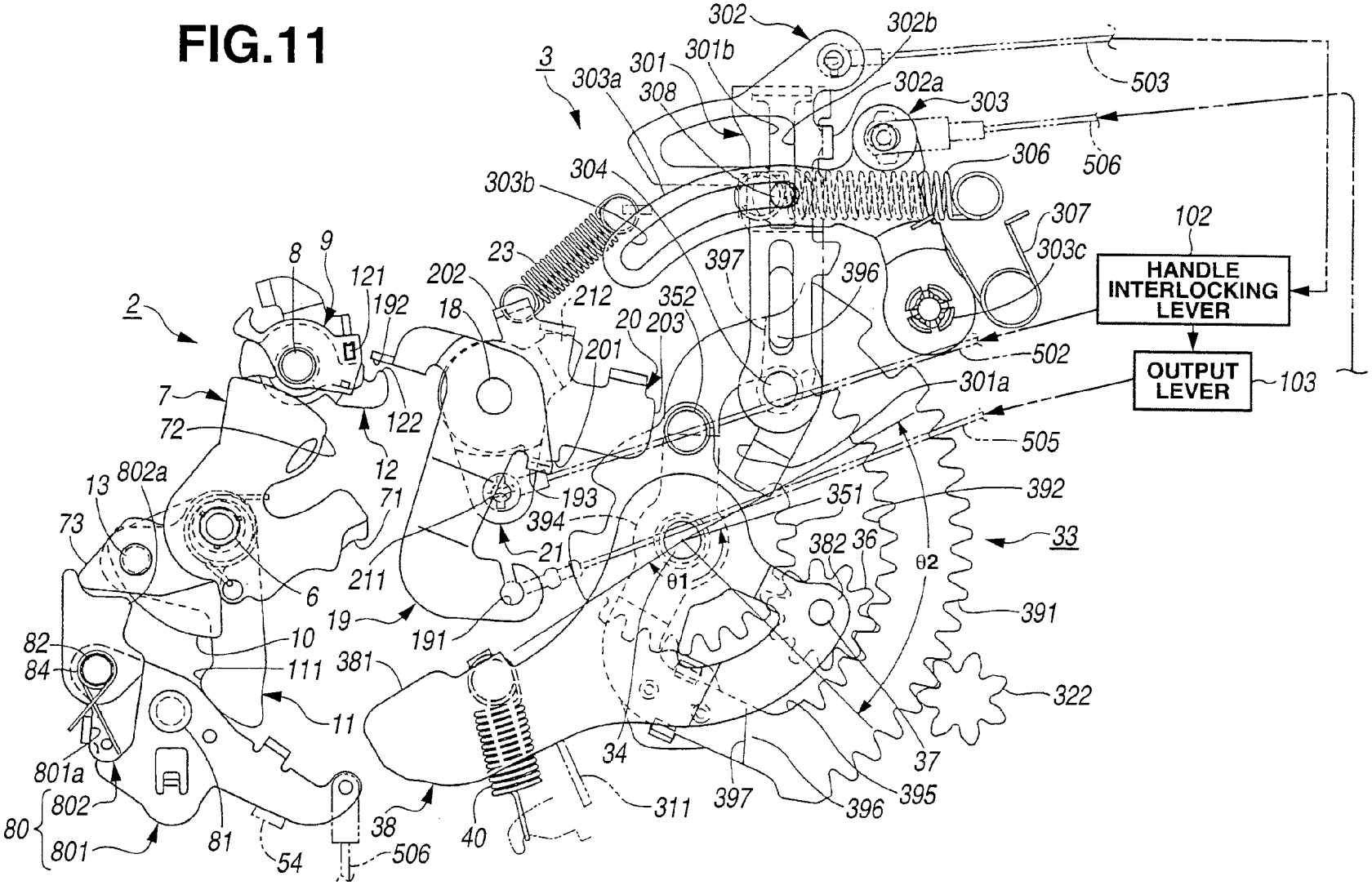
FIG. 11 is a front view showing a main portion of the door latch system in the open state.
Figure 12:
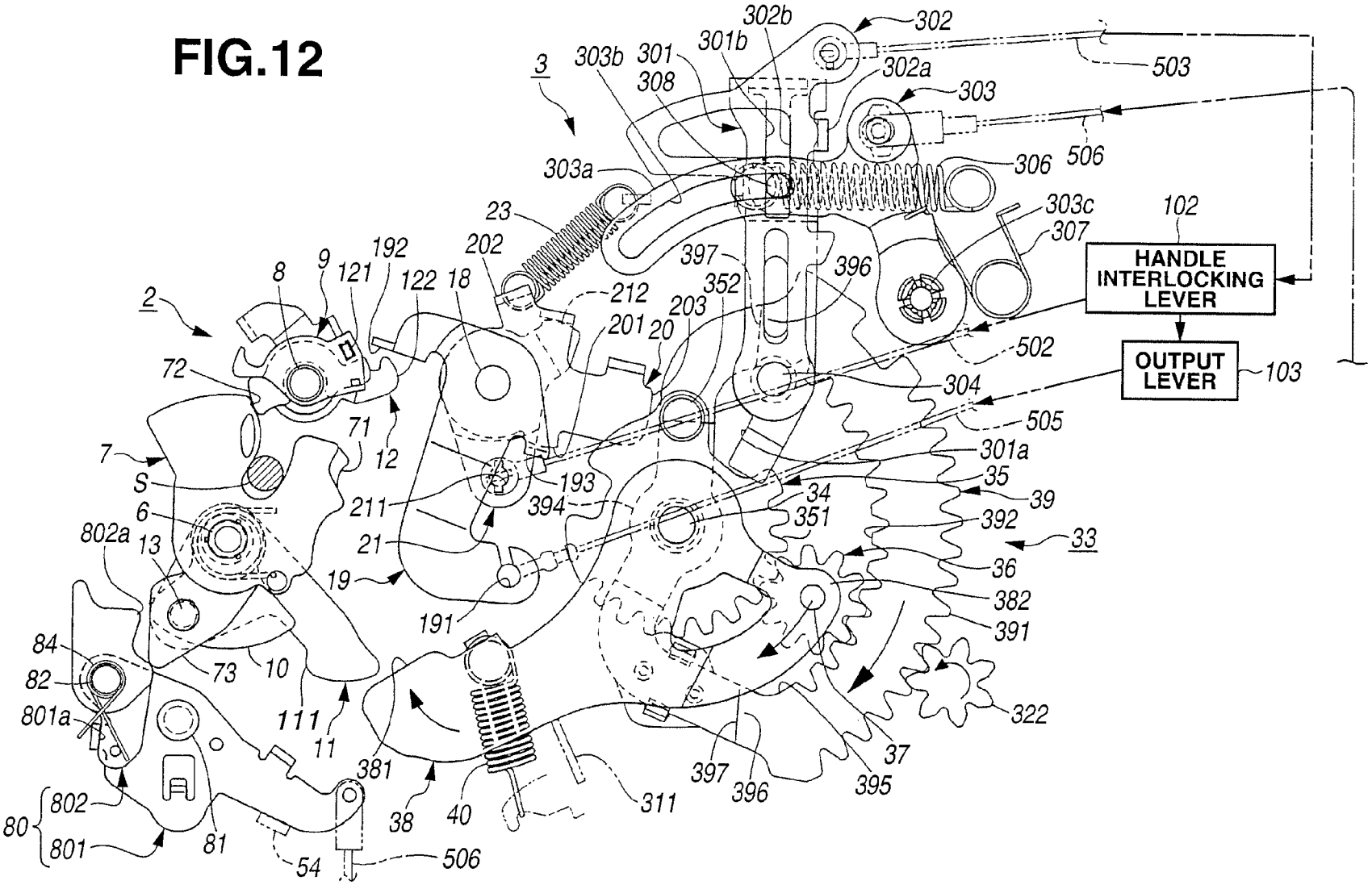
FIG. 12 is a front view showing the main portion of the door latch system in the half latch state.
Figure 13:
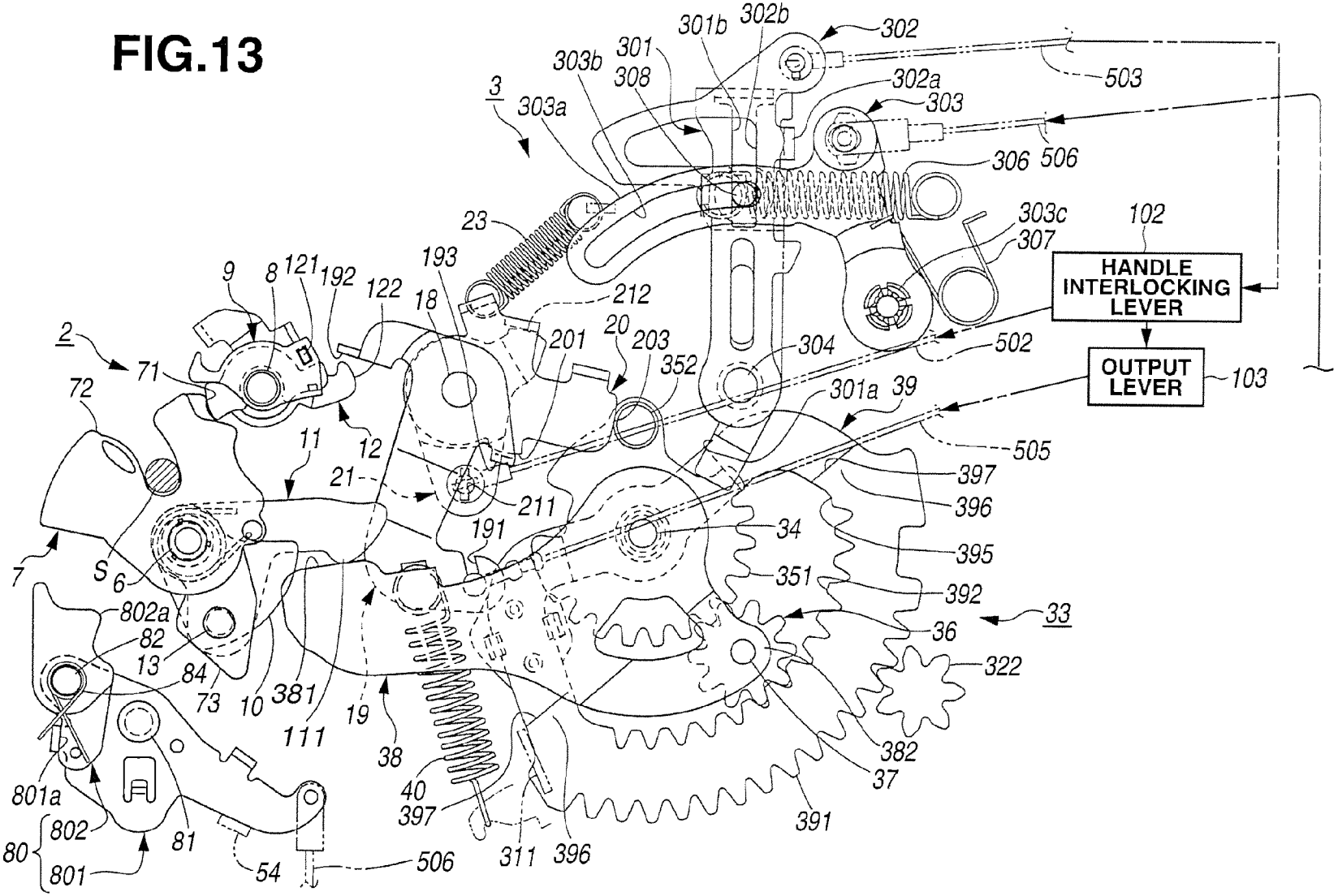
FIG. 13 is a front view showing the main portion of the door latch system during a closing operation.

The latch lever 11 is pivoted as a unit with the latch 7. With this, the latch lever 11 directs in the downward direction as shown in FIG. 11 when the latch 7 is positioned at the open position. The latch lever 11 directs in a forward and obliquely downward direction as shown in FIG. 12 when the latch 7 is positioned at the half latch position. The latch lever 11 directs in the forward direction as shown in FIG. 13 when the latch 7 is positioned at the full latch position. The latch lever 11 includes an actuation portion 111 provided at a tip end portion of the latch lever 11. When the latch 7 is positioned at the open position, this actuation portion 111 is positioned out of a path (trajectory) of a movement of a closing portion 381 of a closing lever 38 (described later) which constitutes a part of the planetary gear mechanism 33. When the latch 7 is moved to the half latch position, this actuation portion 111 enters within the path (trajectory) of the movement of the closing portion 381.

A connection shaft 13 directing in the rearward direction is fixed to rotation surfaces of the sensing lever 10 and the latch lever 11. The connection shaft 13 penetrates through an arc hole 52 which is formed in the housing 5, and which is formed around the latch shaft 6. The connection shaft 13 is fixed to the arm portion 73 of the latch 7, so that the sensing lever 10, the latch lever 11, and the latch 7 are pivoted as a unit with one another.

The open lever 12 includes a first arm portion 121 which directs in the rearward direction, and which penetrates though an arc hole 53 that is formed in the housing 5, and that is formed around the ratchet shaft 8. The first arm portion 121 of the open lever 12 is mounted in the ratchet 9, so that the open lever 12 is pivoted as a unit with the ratchet 9.

A half latch sensing switch 14 and a full latch sensing switch 15 are provided on a front surface side of the housing 5, as shown in FIG. 10. The half latch sensing switch 14 and the full latch sensing switch 15 are arranged to sense the half latch position and the full latch position of the latch 7, respectively. These sensing signals are outputted to a control circuit device (not shown) for starting a stop control and a driving control of a motor 321 serving as an electric driving source in the closer/release unit 3.

The ratchet 9 is constantly urged together with the open lever 12 in the engagement direction (in the counterclockwise direction of FIGS. 5-9 by an urging force of a spring 17 provided on the front surface side of the housing 5. When the latch 7 is positioned at the open position shown in FIG. 5, the ratchet 9 is abutted on the outer circumference edge of the latch 7. When the latch 7 is positioned at the half latch position shown in FIG. 7, the ratchet 9 is held at the engagement position at which the ratchet 9 is engaged with the half latch engagement portion 72 of the latch 7, so as to prevent the pivot movement of the latch 7 in the open direction (in the clockwise directions in FIGS. 5-9) from the half latch position. Moreover, when the latch 7 is positioned at the full latch position shown in FIG. 8, the ratchet 9 is held at the engagement position at which the ratchet 9 is engaged with the full engagement portion 71 of the latch 7, so as to prevent the pivot movement of the latch 7 in the open direction from the full latch position.

Figure 15:
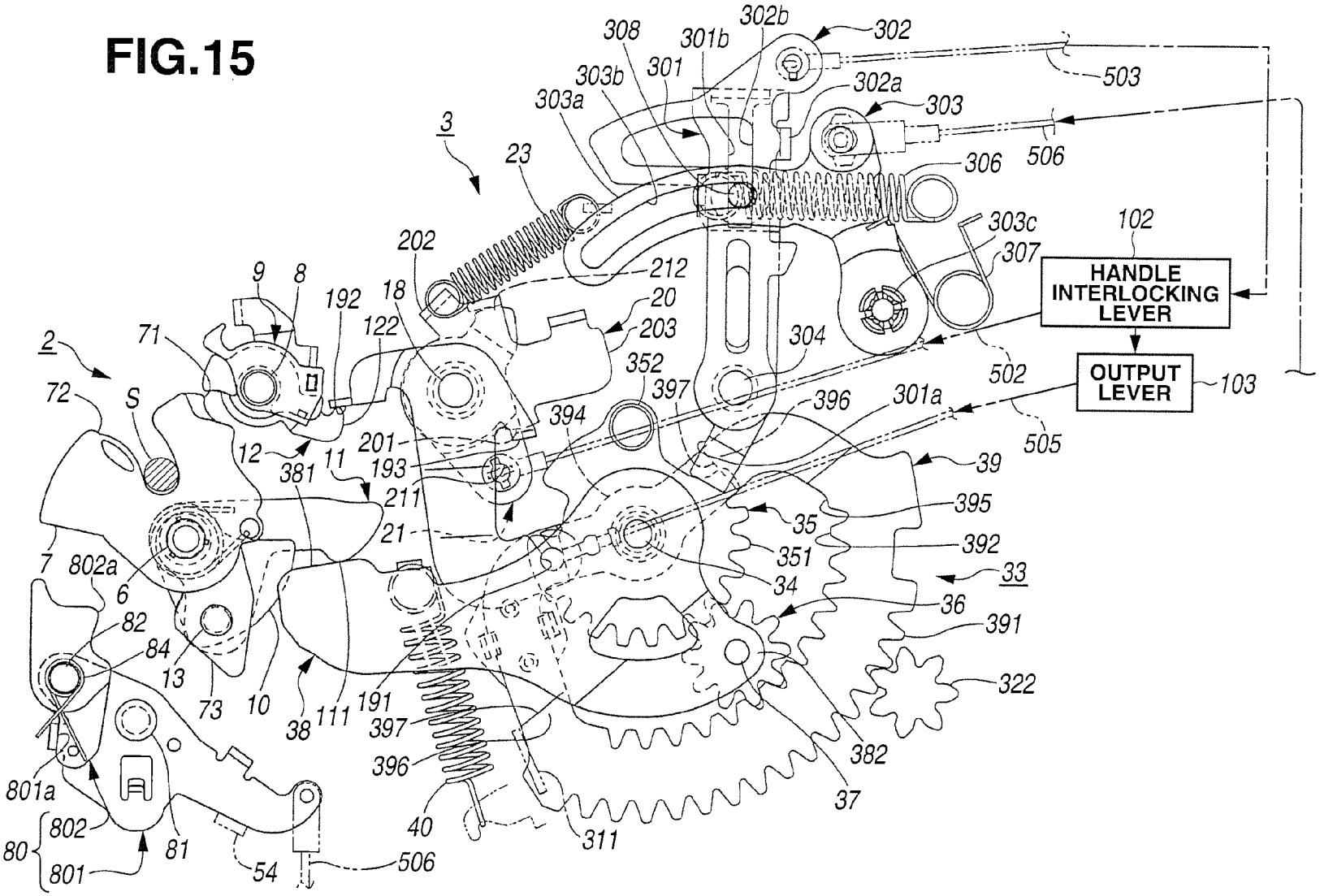
FIG. 15 is a front view showing the main portion of the door latch system in a state where the closing operation is canceled.
Figure 16:
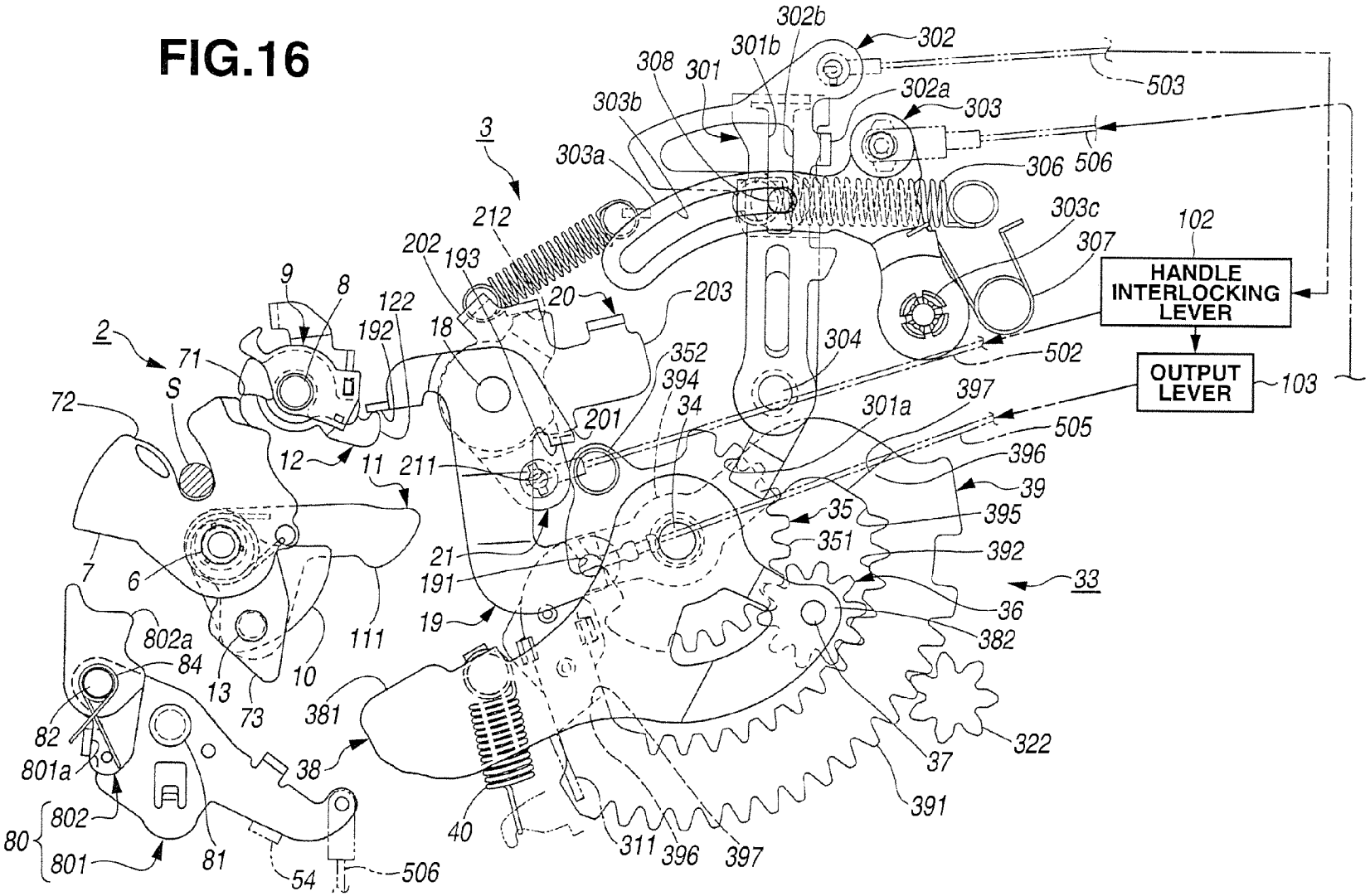
FIG. 16 is a front view showing the main portion of the door latch system after the closing operation is canceled.

In a case in which the ratchet 9 is positioned at the engagement position at which the ratchet 9 is engaged with the full latch engagement portion 71 or the half latch engagement portion 72 of the latch 7 and the lock/unlock mechanism 101 of the operation relay device 100 is in the unlock state, when the outside handle OH or the inside handle IH is operated to open the door, the ratchet 9 is pivoted in a release direction (for example, in the clockwise direction in FIG. 8) through the various elements against the urging force of the spring 17, and moved to the release position shown in FIGS. 15 and 16. With this, the ratchet 9 is disengaged from the full latch engagement portion 71 or the half latch engagement portion 72 so that the door D can be opened.

The latch interlocking mechanism 80 is provided at the lower portion of the housing 5. The latch interlocking mechanism 80 is interlocked with the pivot movement of the latch 7. The latch interlocking mechanism 80 includes a first lever 801 which is provided at the lower portion of the housing 5, and which is pivotally supported by a supporting shaft 81 that extends in the forward and rearward directions; and a second lever 802 which is provided at one end portion of the first lever 801, and which is pivotally supported by a connection shaft 82 extending in the forward and rearward directions.

The first lever 801 is urged in the clockwise direction by a spring 83 including an upper end portion mounted to the first lever 801, and a lower end mounted to the housing 5. With this, the first lever 801 is held at a neutral position at which the first lever 801 is abutted on a stopper 54 provided to the housing 5.

The other end portion of the first lever 801 is connected to the release cancel input lever 303 of the release cancel mechanism (described later), through an operation force transmitting member 506 constituted by a Bowden cable and so on.

The second lever 802 is urged in the clockwise direction by a spring 84 which is wound around the connection shaft 82, and which includes one end mounted to the first lever 801, and the other end mounted to the second lever 802. The second lever 802 is held at a neutral position at which a lower portion of the second lever 802 is abutted on a stopper portion **801*a* provided to the first lever 801** from the clockwise direction.

A cam portion **802*a* is provided to an upper edge of the second lever 802. A tip end of the arm portion 73 pivoted in accordance with the pivot movement of the latch 7 is arranged to be abutted on and slid on the cam portion 802*a* of the second lever 802**.

Figure 6:
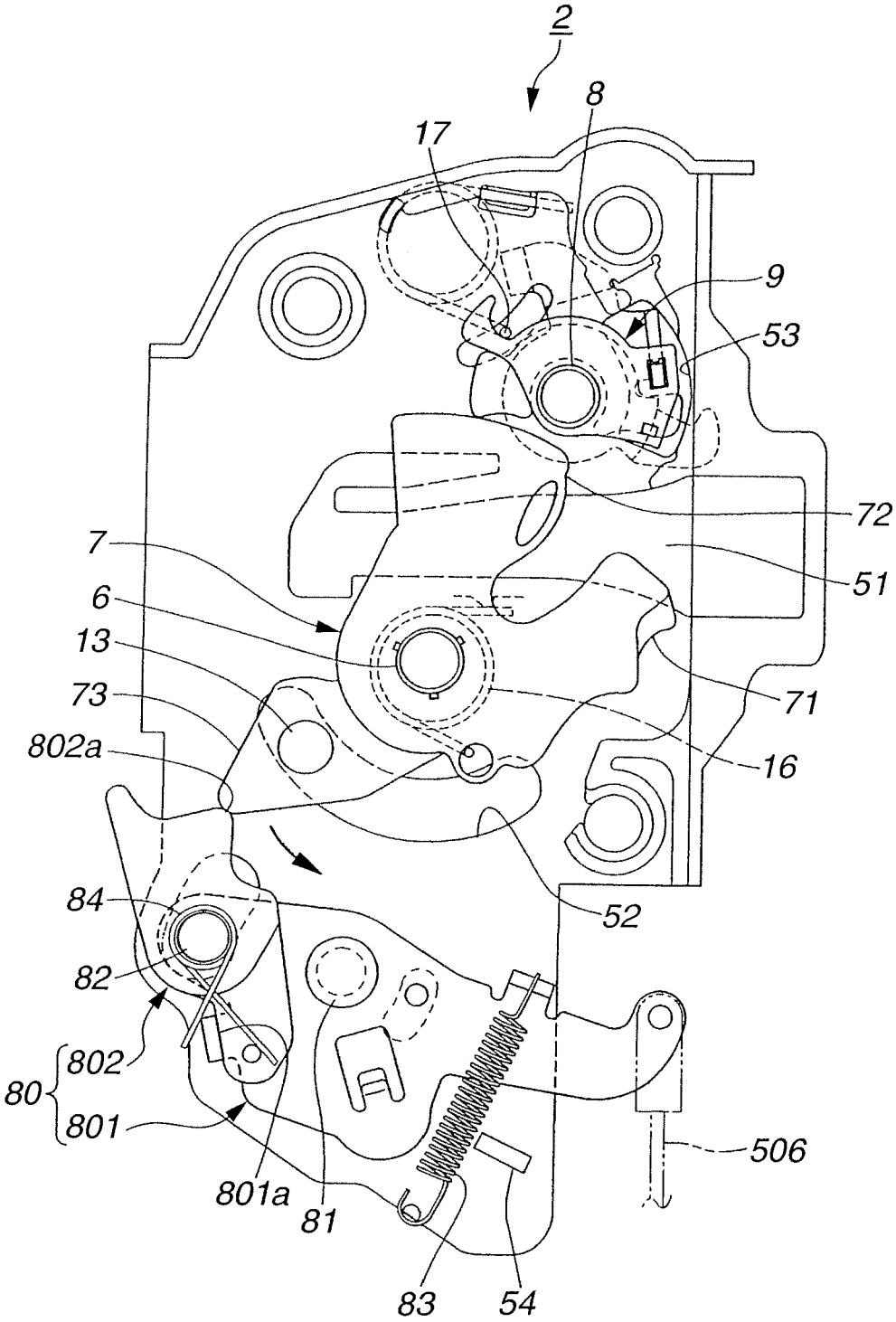
FIG. 6 is a side view showing the inside of the latch unit in a state where a latch is pivoted a predetermined angle from an open position toward a full latch position, in the door latch system according to the first embodiment of the present invention.

When the latch 7 is positioned at the open position as shown in FIG. 5, the arm portion 73 is positioned above the cam portion **802*a* of the second lever 802, and the latch interlocking mechanism 80 including the first lever 801 and the second lever 802 is held at the neutral position. When the latch 7 is pivoted in the closing direction from the open position toward the full latch position, the arm portion 73 moves the second lever 802 in the downward direction while sliding on the cam portion 802*a* of the second lever 802. Then, when the latch 7 is moved to the predetermined pivot position (the position between the open position and the half latch position) as shown in FIG. 6, the tip end portion of the arm portion 73 is abutted on an apex portion of the cam portion 802***a* of the second lever 802. With this, the second lever 802 is moved to a lowermost position in a state in which the second lever 802 is abutted on the stopper portion 801*a* of the first lever 801. Consequently, the first lever 801 is pivoted a predetermined angle against the urging force of the spring 83, in the counterclockwise direction (in a release cancel direction) from the neutral position to the release cancel position. The release cancel actuation of the first lever 801 is transmitted through the operation force transmitting member 506 to the release cancel input lever 303, so that the release cancel input lever 303 performs the release cancel actuation.

When the latch 7 passes through the predetermined pivot position, and furthermore moves toward the full latch position, the arm portion 73 is detached from the cam portion 802*a* immediately before the latch 7 is moved to the half latch position. With this, the first and second levers 801 and 802 are returned to the neutral positions by the urging force of the spring 83 as shown in FIGS. 7 and 8. When the first lever 801 is returned to the neutral position, the release cancel input lever 303 is also returned to the neutral position.

Figure 9:
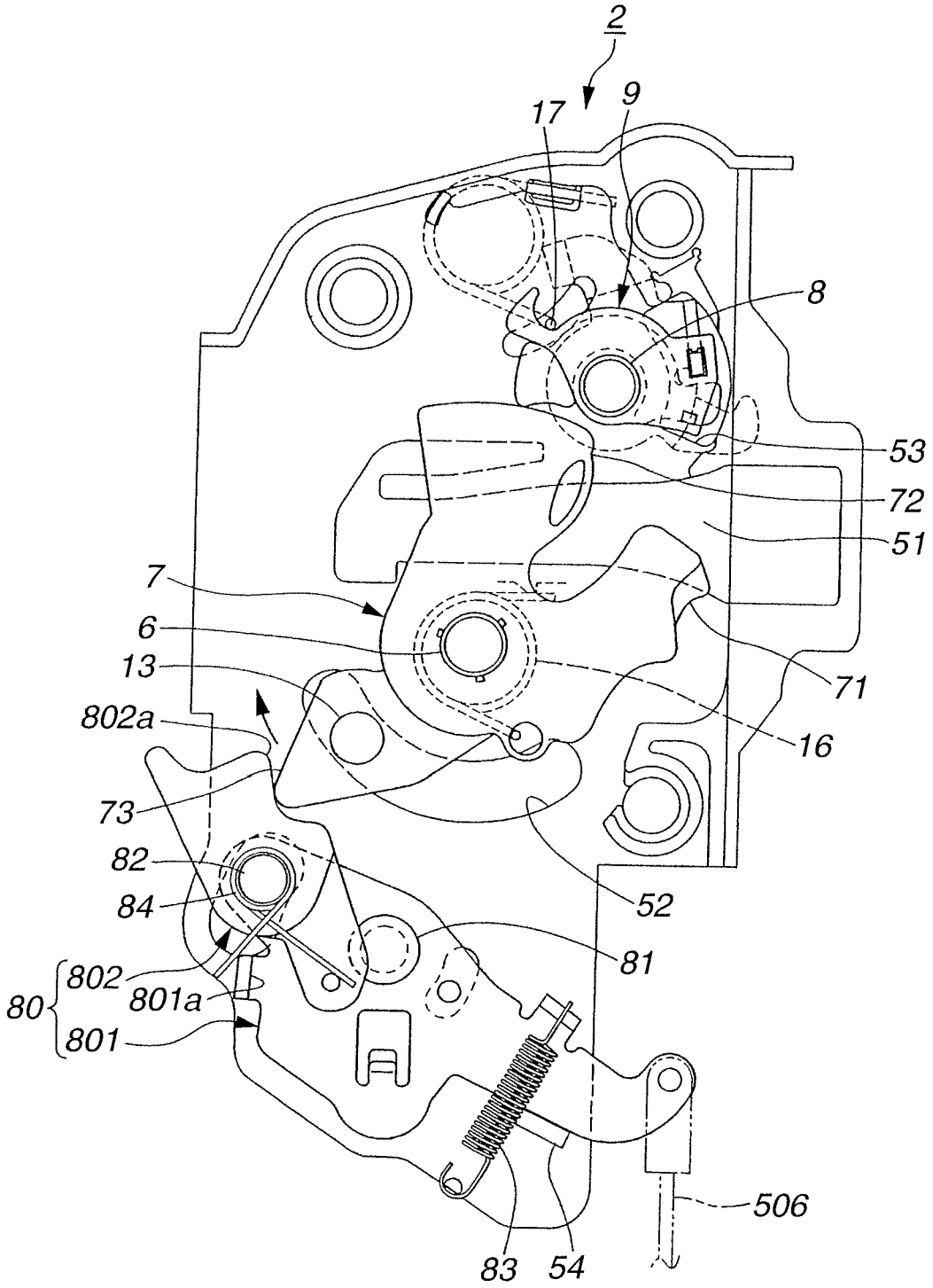
FIG. 9 is a side view showing the inside of the latch unit when the latch is pivoted from the full latch position toward the open position, in the door latch system according to the first embodiment of the present invention.

When the latch 7 is positioned at the full latch position as shown in FIG. 8, the arm portion 73 is detached from the cam portion 801*a* of the first lever 801. Accordingly, the first and second levers 801 and 802 are held at the neutral positions by the urging forces of the springs 83 and 84. When the latch 7 is pivoted from the full latch position toward the open position, the arm portion 73 is abutted on the cam portion 802*a* of the second lever 802 from the clockwise direction in accordance with the pivot movement of the latch 7 as shown in FIG. 9. In this case, the second lever 802 is merely pivoted on the connection shaft 82 in the counterclockwise direction against the urging force of the spring 84. Accordingly, the first and second levers 801 and 802 are not actuated in the release cancel direction. That is, the latch interlocking mechanism 80 does not perform the release actuation.

As described above, the latch interlocking mechanism 80 performs the release cancel operation when the latch 7 is positioned at the predetermined pivot position, that is, when the latch 7 is positioned between the open position and the half latch position. With this, in a structure in which the latch interlocking mechanism 80 performs the release cancel operation when the latch 7 is pivoted from the open position to the full latch position, the ratchet 9 can be surely engaged with the half latch engagement portion 72 and the full latch engagement portion 71 after the latch 7 passes through the predetermined pivot position.

As shown in FIG. 3, a support surface 42 is formed by bending the cover plate 4 in the forward direction. A release input lever 19, a block lever 20, and an emergency lever 21 are pivotally supported on the support surface 42 by a support shaft 18 extending in the inside and outside directions of the vehicle (in the lateral direction of the vehicle).

The release input lever 19 includes a connection portion 191 which is provided at a lower portion of the release input lever 19, and which is connected to a rear end portion of the operation force transmitting member 505 extending within the door D in the forward and rearward directions. A front end portion of the operation force transmitting member 505 is connected to the output lever 103 of the operation relay device 100. Accordingly, in a case where one of the outside handle OH and the inside handle IH is operated to open the door, the release input lever 19 is swung against an urging force of a spring 23 in the release direction (in the counterclockwise direction in FIGS. 11-14) from the neutral position shown in FIGS. 11-14 to the release position shown in FIGS. 15 and 16 only when the lock/unlock mechanism 101 of the operation relay device 100 is in the unlock state. When the release input lever 19 is pivoted to the release position, a release portion 192 which is provided at a rear end portion of the release lever 19 moves an upper end of the second arm portion 122 of the open lever 12 in the downward direction, so as to pivot the ratchet 9 in the release direction through the open lever 12. With this, the engagement between the ratchet 9 and the full latch engagement portion 71 or the half latch engagement portion 72 of the latch 7 is released so that the door can be opened.

Besides, the release input lever 19 is connected to the output lever 103 of the operation relay device 100. Accordingly, when the lock/unlock mechanism 101 is in the unlock state, the release input lever 19 is pivoted in the release direction by the door open operation of the outside handle OH or the inside handle IH. On the other hand, when the lock/unlock mechanism 101 is in the lock state, the release input lever 19 is continued to be located at the neutral position even when the outside handle OH or the inside handle IH is operated to open the door, so that the release input lever 19 is not moved in the release direction.

The block lever 20 is held by the urging force of the spring 23 at a block position (positions shown in FIGS. 11-14 and so on) at which a block portion 203 formed at the tip end of the arm extending in the forward direction directs in the forward direction. When the release input lever 19 is pivoted in the release direction to the release position (a position shown in FIG. 17 and so on), a bending portion 193 of the release input lever 19 is abutted on an abutment portion 201 of the block lever 20 from the downward direction. Consequently, the block lever 20 is pivoted a predetermined angle in the counterclockwise direction from the block position to a cancel position shown in FIGS. 15-17.

When the block lever 20 is held at the block position (positions shown in FIGS. 11-14 and so on), the block portion 203 inhibits a pivot movement of a sun gear 35 (described later) of a planetary gear mechanism 33 in the counterclockwise direction. Moreover, when the block lever 20 is moved to the cancel position (positions shown in FIGS. 15-17 and so on), the block portion 203 allows a free pivot movement of the sun gear 35 in the counterclockwise direction. With this, when the block lever 20 is positioned at the block position, it is possible to transmit a reduced speed rotation of the planetary gear mechanism 33 to the latch 7, as described below. Moreover, when the block lever 20 is positioned at the cancel position, the transmission of the reduced speed rotation of the planetary gear mechanism 33 is disconnected, so that it is not possible to transmit the reduced speed rotation of the planetary gear mechanism 33 to the latch 7.

The emergency lever 21 includes a connection portion 211 which is provided at a lower portion of the emergency lever 21, and which is connected to a rear end portion of the operation force transmitting member 502 extending within the door D in the forward and rearward directions. A front end portion of the operation force transmitting member 502 is connected with the handle interlocking lever 102 of the operation relay device 100. With this, the operation of the handle interlocking lever 102 is transmitted through the operation force transmitting member 502 to the emergency lever 21. Accordingly, the emergency lever 21 is pivoted in the release direction (in the counterclockwise direction in FIGS. 11-14) from the neutral position (positions shown in FIGS. 11-14 and so on) to be interlocked with the door open operation of the outside handle OH or the inside handle IH, irrespective of whether the lock/unlock mechanism 101 is in the unlock state or the lock state.

When the emergency lever 21 is pivoted in the release direction, an abutment portion 212 provided at an upper end of the emergency lever 21 is abutted on the bending portion 202 of the block lever 20 from the downward direction. With this, the block lever 20 is pivoted in the release direction against the urging force of the spring 23. Besides, in this case, the release input lever 19 is continued to be held at the neutral position. Accordingly, the ratchet 9 is not pivoted in the release direction. With this, the block lever 20 can be pivoted to the cancel position by the door open operation of the outside handle OH or the inside handle IH, irrespective of the state of the lock/unlock mechanism 101. With this, the close operation of the closer/release unit 3 can be interrupted as described below.

Next, the closer/release unit 3 will be illustrated. As shown in FIG. 3, the closer/release unit 3 includes a base plate (base member) 31 which is made from a metal, and which is fixed to the support surface 42 of the cover plate 4 of the latch unit 2 by two upper and lower rivets 25; a drive unit 32 which is disposed at a front portion of a surface of the base plate 31 that confronts the outside of the vehicle, and which includes a motor 321 serving as the electric driving source, and a reduction gear arranged to reduce a speed of a rotation of the motor 321; the planetary gear mechanism 33 which is disposed at a central portion (between the latch 7 of the latch unit 2 and the drive unit 32) of the surface of the base plate 31 that directs in the outside direction of the vehicle, and which serves as a speed reduction mechanism that is engaged with an output gear 322 arranged to output the rotational force of the motor 321, and to be rotated on a shaft extending in the inside and outside directions of the vehicle (in the lateral direction of the vehicle), and that is arranged to further reduce the speed of the rotation of the output gear 322, and to output that reduced speed rotation; and a release cancel mechanism including a first release output lever 301, a second release output lever 302, and the release cancel input lever 303 that are pivotally supported on the base plate 31.

The release cancel mechanism is arranged to be switched between a connection state (a state shown in FIGS. 11-17) in which a release actuation (described later) of the planetary gear mechanism 33 by a positive rotation of the motor 321 can be transmitted to the ratchet 9, and a disconnection state (a state shown in FIG. 18) in which the operation force transmitting path connecting the planetary gear mechanism 33 and the ratchet 9 is disconnected.

The first release output lever 301 is pivotally supported on the base plate 31 by a support shaft 304 extending in the inside and outside directions of the vehicle (in the lateral direction of the vehicle), and arranged to be pivoted in the forward direction and in the rearward direction. The first release output lever 301 includes a release portion 301*a* extending in the downward direction, and an elongated hole 301*b* which extends in the upward and downward directions, and with which a floating pin 308 extending in the inside and outside directions of the vehicle (in the lateral direction of the vehicle) is engaged to be slid in the upward and downward directions. The first release output lever 301 is urged in the clockwise direction in FIG. 11 and so on by a spring 306. The first release output lever 301 is held at a neutral position shown in FIG. 11 and so on in the non-actuation state. Moreover, the first release output lever 301 is arranged to be pivoted in the release direction (in the counterclockwise direction in FIG. 11) from the neutral position against the urging force of the spring 306, based on the release actuation (described later) of the planetary gear mechanism 33.

The second release output lever 302 is pivotally supported on the base plate 31 to be coaxial with the first release output lever 301. The second release output lever 302 includes a bending portion 302*a* which is provided at an upper portion of the second release output lever 302. The bending portion 302*a* of the second release lever 302 is arranged to be abutted on the first release output lever 301 (a right side surface of the first release output lever 301 in FIG. 11) in the pivot direction of the first release output lever 301 so as to be interlocked with the actuation of the first release output lever 301 in the neutral direction (in the clockwise direction in FIG. 11).

An upper end portion of the second release output lever 302 is connected to a rear end portion of the operation force transmitting member 503 which extends in the forward and rearward directions, and which is arranged to transmit the actuation of the second release output lever 302 in the release direction (in the counterclockwise direction of FIG. 11) from the neutral position (cf. FIG. 11 and so on), to the handle interlocking lever 102 of the operation relay device 100. Moreover, the second release output lever 302 includes an elongated hole 302*b* which is formed into an inversed L-shape, and with which the floating pin 308 is arranged to be slidably engaged.

The release cancel input lever 303 is pivotally supported on the base plate 31 by a support shaft 303*c* extending in the inside and outside directions of the vehicle (in the lateral direction of the vehicle), and arranged to be pivoted in the forward and rearward directions. The release/cancel input lever 303 is usually held at the connection position (cf. FIG. 11 and so on) by an urging force of a spring 307. The release cancel input lever 303 includes an arm portion 303*a* extending in the rearward direction. The arm portion 303*a* includes an elongated hole 303*b* which extends in the forward and rearward directions, which is overlapped with the elongated hole 302*b* of the second release output lever 302, and with which the floating pin 308 is engaged to be slid in the forward and rearward directions.

An upper portion of the release cancel input lever 303 is connected with one end portion of the operation force transmitting member 506 arranged to transmit the release cancel actuation of the first lever 801 of the latch interlocking mechanism 80, to the release cancel input lever 303. With this, the release cancel input lever 303 is usually held at the connection position at which the release cancel mechanism is brought to the connection state.

However, when the latch interlocking mechanism 80 performs the release cancel actuation, the release cancel input lever 303 is pivoted a predetermined angle in the disconnection direction (in the clockwise direction in FIG. 11 and so on) from the connection position against the urging force of the spring 306 to be interlocked with the release cancel actuation of the latch interlocking mechanism 80, and pivoted to the disconnection position (cf. FIG. 18) at which the release cancel mechanism is brought to the disconnection state.

The floating pin 308 follows the release cancel lever 303. When the release cancel input lever 303 is positioned at the connection position, the floating pin 308 is positioned at a lower portion (for example, a position shown in FIG. 11) of the elongated hole 302*b* of the second release output lever 302, and held at the connection position at which the release cancel mechanism is brought to the connection state. Moreover, when the release cancel input lever 303 is moved to the disconnection position, the floating pin 308 is positioned at an upper portion of the elongated hole 302*b* (a position shown in FIG. 18), and moved to the disconnection position at which the release cancel mechanism is brought to the disconnection state.

Figure 14:
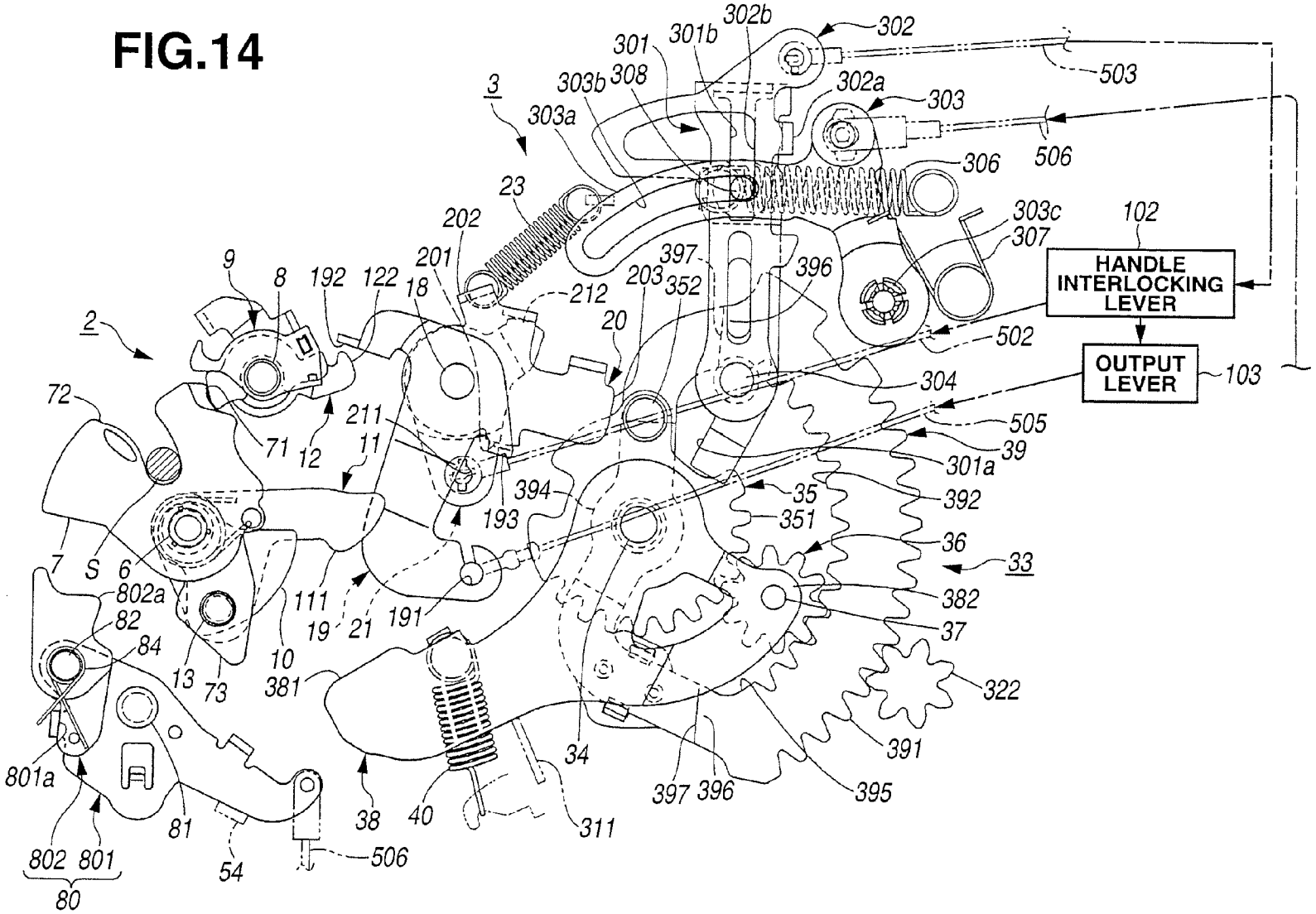
FIG. 14 is a front view showing the main portion of the door latch system in the full latch state.

When the release cancel input lever 303 and the floating pin 308 are positioned at the connection positions and the release cancel mechanism is in the connection state as shown in FIG. 14, the operation force transmitting path between the first release output lever 301 and the second release output lever 302 is connected. With this, the release actuation of the first release output lever 301 by a release actuation (described later) of the planetary gear mechanism 33 is transmitted to the ratchet 9 through the floating pin 308, the second release output lever 302, the operation force transmitting member 503, the handle interlocking lever 102, the output lever 103, the operation force transmitting member 505, the release input lever 19, and the open lever 12. Consequently, the ratchet 9 is pivoted to the release position so that the door D can be opened. Moreover, the actuation of the handle interlocking lever 102 is transmitted through the output lever 103 and the operation force transmitting member 504 to the front door latch FD when the lock/unlock mechanism 101 of the operation relay device 100 is in the unlock state.

Figure 18:
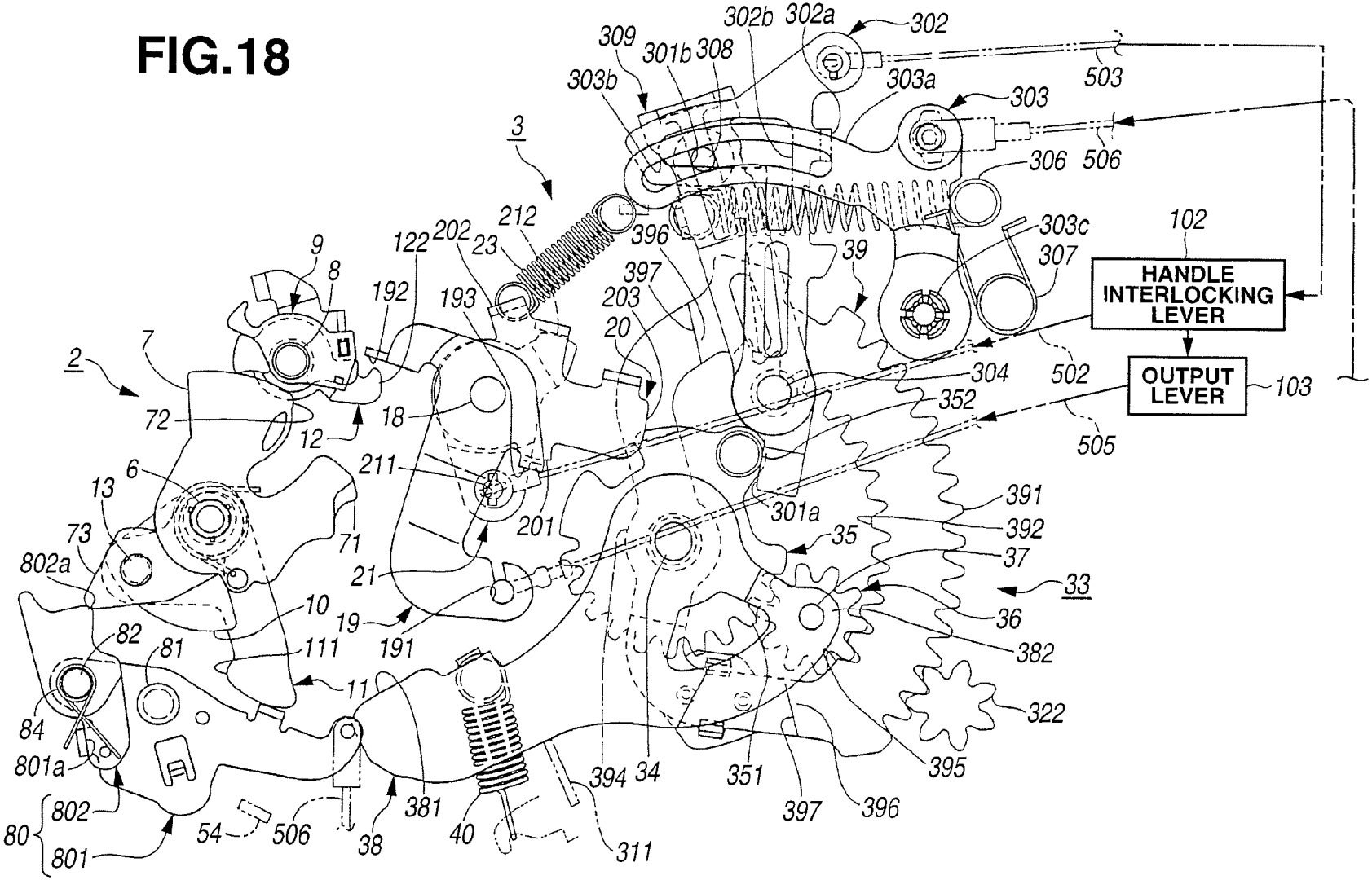
FIG. 18 is a front view showing the main portion of the door latch system in a state where the releasing operation is canceled.

When the release cancel input lever 303 and the floating pin 308 are moved to the release cancel positions so that the release cancel mechanism is brought to the release cancel state as shown in FIG. 18, the operation force transmitting path between the first release output lever 301 and the second release output lever 302 is disconnected. With this, it is possible to close the door D in a following manner even when there is generated a release restriction state in which the first release output lever 301 is restricted at the release position due to an electric failure (malfunction) or other causes in a state where the planetary gear mechanism 33 is in the release actuation state, the first release output lever 301, the second release output lever 302 and so on cannot be returned to the neutral positions, and the ratchet 9 is restricted to the release position so that the door D cannot be closed. That is, in the door latch system according to the first embodiment of the present invention, when the release restriction state is generated, the release cancel input lever 303 is moved to the release cancel position, so that the operation force transmitting path between the first release output lever 301 and the second release output lever 302 is disconnected so as to cancel the release restriction state. With this, the second release output lever 302, the release input lever 19 and so on can be returned to the neutral position, and the ratchet 9 can be returned to the neutral position while the first release output lever 301 is left at the release position. Accordingly, the closing operation of the door D can be performed, that is, the engagement of the latch unit 2 with respect to the striker S can be performed.

The planetary gear mechanism 33 has the close function to move the latch mechanism of the latch unit 2 from the half latch state to the full latch state, that is, to move the latch 7 from the half latch position to the full latch position, and the release function to actuate the ratchet 9 to perform the release operation so that the door can be opened.

As shown in FIGS. 3 and 4, the planetary gear mechanism 33 includes a sun gear 35 which is a rotational member constituting a part of the planetary gear mechanism 33, and which is pivotally supported on a surface of the base plate 31 that directs the outside of the vehicle, by a support shaft 34 extending in the inside and outside directions of the vehicle (in the lateral direction of the vehicle); a single planetary gear 36 which is engaged with the sun gear 35, and which is arranged to be pivoted around the sun gear 35 (the support shaft 34) while rotating on its axis; a close lever 38 which is pivotally supported by the support shaft 34, and which pivotally supports the planetary gear 36 by a shaft 37 extending in the inside and outside directions of the vehicle (in the lateral direction of the vehicle); and a sector gear 39 which serves as a ring gear that is pivotally supported by the support shaft 34, and that includes an externally toothed gear 391 which is formed on an outer circumference of the sector gear 39, and which is engaged with the output gear 322, and an internally toothed gear 392 which is formed on an inner circumference of the sector gear 39, and which is engaged with the planetary gear 36.

As shown in FIG. 11, the sun gear 35 includes an externally toothed gear 351 which is formed on an outer circumference of a sector shape having a central angle θ1 of substantially 170 degrees, and which is engaged with the planetary gear 36; and an abutment portion 352 that is formed into a cylindrical shape, that is provided at an upper portion of a rotation surface at which the externally toothed gear 351 is not formed, and that protrudes in the inside direction of the vehicle.

The abutment portion 352 of the sun gear 35 is arranged to be abutted on the block portion 203 of the block lever 20 with respect to the pivot movement of the sun gear 35 in the counterclockwise direction so as to prevent the pivot movement of the sun gear 35 in the counterclockwise direction. Moreover, the sun gear 35 is arranged to be pivoted in the clockwise direction so as to be abutted on the release portion 301*a* of the first release output lever 301, so that the first release output lever 301 is actuated in the release direction. That is, in the normal state (in a state in which the block lever 20 is positioned at the neutral position), the sun gear 35 can be pivoted in the clockwise direction from a sun gear neutral position (for example, a position shown in FIG. 11), and however the sun gear 35 cannot be pivoted in the counterclockwise direction from the sun gear neutral position.

When the block lever 20 is positioned at the block position (the positions shown in FIGS. 11-14 and so on), the block portion 203 of the block lever 20 is positioned within a path (trajectory) of the movement of the abutment portion 352. Accordingly, when the sun gear 35 is slightly pivoted in the counterclockwise direction from the position shown in FIG. 11, the block portion 203 of the block lever 20 is abutted on the abutment portion 352 so as to block the pivot movement of the sun gear 35 in the counterclockwise direction. Moreover, when the block lever 20 is positioned at the cancel position (positions shown in FIGS. 15 and 16 and so on), the block portion 203 of the block lever 20 is positioned out of the path (trajectory) of the movement of the abutment portion 352, so as to allow the free rotation of the sun gear 35 in the counterclockwise direction.

In a state where the planetary gear mechanism 33 is not actuated, that is, in the neutral state (for example, in the state shown in FIG. 11), the sun gear 35 is set at the neutral position at which the externally toothed gear 351 directs in the downward direction, and the abutment portion 352 is positioned at the uppermost position.

As shown mainly in FIG. 11, the close lever 38 includes a close portion 381 which is located at a tip end portion of an arm extending in the rearward direction, that is, one end portion of the arm that is closer to the latch 7 of the latch unit 2 than the support shaft 34, which directs in the upward direction, and which is arranged to be abutted on the actuation portion 111 of the latch lever 11; and a pivotally supporting portion 382 which is located at a tip end portion of the arm extending in the forward and obliquely downward direction, that is, the other end portion of the arm which is farther from the latch 7 than the support shaft 34, and which pivotally supports the planetary gear 36 by the shaft 37.

In the neutral state of the planetary gear mechanism 33 (for example, in the state shown in FIG. 11), the close lever 38 is urged in the counterclockwise direction by a spring 40 including one end mounted to the close lever 38, and the other end mounted to the base plate 31, and thereby abutted on a stopper portion 311 provided to the base plate 31 from the upward direction. With this, the closer lever 38 is held at the neutral position at which the close portion 381 directs in the rearward and obliquely downward direction, and the pivotally supporting portion 382 directs in the forward and obliquely downward direction, that is, a direction in which the output gear 322 is positioned. Accordingly, when the close lever 38 is positioned at the neutral position, the planetary gear 36 and the output gear 322 confront each other to sandwich the externally toothed gear 391 and the internally toothed gear 392 of the sector gear 39. With this, when the planetary gear mechanism 33 is in the neutral state, the externally toothed gear 391 and the internally toothed gear 392 of the sector gear 39 are sandwiched between the planetary gear 36 and the output gear 322 which confront each other. Accordingly, it is possible to suppress the backlash of the sector gear 39.

As shown in FIG. 11, the sector gear 39 includes the externally toothed gear 391 which is formed on an outer circumference of a sector shape having a central angle θ2 of substantially 80 degrees, and the internally toothed gear 392 which is formed on an inner circumference of the same sector shape. The sector gear 39 includes a support portion 394 (cf. FIG. 3) having a shaft hole 393 (cf. FIG. 3) in which the support shaft 34 is inserted; and an opening portion 395 which is located between the support portion 394 and the internally toothed gear 392, and which receives the planetary gear 36 engaged with the internally toothed gear 392. The planetary gear 36 is pivoted around the sun gear 35 and rotated on its axis in a state where the planetary gear 36 is received within the opening portion 395.

In the neutral state of the planetary gear mechanism 33, the sector gear 39 is set at a ring gear neutral position at which the externally toothed gear 391 directs in the forward direction, that is, in a direction opposite to the direction in which the latch 7 of the latch unit 2 is disposed. Besides, the ring gear neutral position of the sector gear 39 is sensed by a sensing switch 62 (cf. FIG. 4) disposed below the sector gear 39.

The sector gear 39 includes upper and lower bridge portions 396 which connect the support portion 394 and the circumference portion in which the externally toothed gear 391 and the internally toothed gear 392 are formed. Moreover, the sector gear 39 includes stepped portions 397 which are formed on the upper and lower bridge portions 396 so that the circumference portion is positioned closer to the surface of the base plate 31 than the support portion 394. With this, in a state where the close lever 38, the sun gear 35, and the sector gear 39 are overlapped on the base plate 31 in the axial direction of the support shaft 34, all of the externally toothed gear 351 of the sun gear 35, the planetary gear 36, the externally toothed gear 391 and the internally toothed gear 392 of the sector gear 39, and the output gear 322 are substantially aligned in the same plane. With this, it is possible to decrease the size of the planetary gear mechanism 33 in the axial direction of the support shaft 34, and to attain the smooth actuation.

In a case where the block lever 20 is positioned at the block position and the planetary gear mechanism 33 is in the neutral state as shown in FIG. 11, when the sector gear 39 is pivoted on the support shaft 34 in the close direction (in the clockwise direction) in accordance with the positive rotation of the motor 321, the pivot movement of the sun gear 35 in the counterclockwise direction at this time is blocked by the block portion 203 of the block lever 20. Accordingly, the planetary gear 39 is pivoted around the sun gear 35 in the clockwise direction while rotating on its axis (in the clockwise direction). With this, the close lever 38 is swung on the support shaft 34 in the close direction (in the clockwise direction) to follow the pivot movement of the planetary gear 36 around the sun gear 35 at a speed lower than the speed of the sector gear 39. Consequently, the close lever 38 is pivoted to the close position at which the close portion 381 directs in the directly upward direction, as shown in FIG. 13.

Moreover, in a case where the block lever 20 is positioned at the block position and the planetary gear mechanism 33 is in the neutral state as shown in FIG. 11, when the sector gear 39 is pivoted on the support shaft 34 in the release direction (in the counterclockwise direction) in accordance with the reverse rotation of the motor 321, the planetary gear 36 pivotally supported by the close lever 38 is not pivoted around the sun gear 35, and the planetary gear 36 is rotated on its axis in the counterclockwise direction since the close lever 38 is urged in the counterclockwise direction by the urging force of the spring 40 and held at the neutral position. Consequently, the sun gear 36 is pivoted the predetermined angle in the clockwise direction, that is, in the release direction, based on the rotation of the planetary gear 36 on its axis. With this, the abutment portion 352 is abutted on the release portion 301*a* of the first release output lever 301 from the rearward direction, so as to actuate the first release output lever 301 in the release direction.

When the release cancel input lever 303 is positioned at the connection position, the release actuation of the first release output lever 301 is transmitted to the floating pin 308, the second release output lever 302, the operation force transmitting member 503, and the handle interlocking lever 102 of the operation relay device 100. Moreover, when the lock/unlock mechanism 101 of the operation relay device 100 is in the unlock state, the release actuation of the handle interlocking lever 102 is transmitted to the ratchet 9 through the output lever 103, the operation force transmitting member 505, the release input lever 19, and the open lever 12. With this, the ratchet 9 performs the release actuation so as to release the engagement with the latch 7, so that the door D can be opened. After the release actuation of the latch mechanism is finished, the motor 321 is controlled to be rotated in the reverse direction, so that the planetary gear mechanism is returned to the neutral state.

Besides, the electric driving mechanism in the door latch system according to this embodiment of the present invention is constituted by the motor 321, the output gear 322, and the planetary gear mechanism 33 which serves as the speed reduction mechanism. However, the present invention is not limited to this structure. As long as the electric driving mechanism includes at least the motor, the speed reduction mechanism may be omitted, or the speed reduction mechanism may be constituted by a worm gear, a spur gear and so on.

Next, an operation of the door latch system is illustrated with reference to FIGS. 5-9 and 11-18.

(Closing Operation)

When the door D is closed to the half-shut position in a state in which the door D is opened, that is, in a state in which the latch unit 2 is in the open state and all of the elements of the closer/release unit 3 are in the neutral state as shown in FIGS. 5 and 11, the striker S is engaged with the latch 7 as shown in FIGS. 7 and 12, so that the latch 7 is pivoted from the open position to the half latch position. Moreover, the ratchet 9 is engaged with the half latch engagement portion 72 of the latch 7. In this case, the actuation portion 111 of the latch lever 11 is moved into the path (trajectory) of the movement of the close portion 381 of the close lever 38 by the pivot movement of the latch 7 to the half latch position.

When the half latch sensing switch 14 senses that the latch 7 is pivoted to the half latch position, the motor 321 is controlled to rotate in the positive direction by the control circuit device. With this, in the half latch state shown in FIG. 12, the output gear 322 is pivoted in the counterclockwise direction shown by an arrow in FIG. 12, so that the sector gear 39 is swung on the support shaft 34 in the close direction shown by an arrow. In this case, the block lever 20 is positioned at the block position at which the block portion 203 can be abutted on the abutment portion 352 of the sun gear 35. Accordingly, the sun gear 35 is slightly swung in the counterclockwise direction, and then the abutment portion 352 of the sun gear 35 is abutted on the block portion 203, so that the swing movement of the sun gear 35 in the counterclockwise direction is blocked. Consequently, the planetary gear 36 is pivoted around the sun gear 35 in the clockwise direction while rotating on its axis in the clockwise direction in a state where the planetary gear 36 is received within the opening portion 395 of the sector gear 39.

The closing lever 38 is swung in the close direction (in the clockwise direction) shown by an arrow against the urging force of the spring 40 in accordance with the pivot movement of the planetary gear 36 around the sun gear 35 in the clockwise direction. The closing portion 381 of the closing lever 38 is moved in the upward direction so as to move the actuation portion 111 of the latch lever 11 in the upward direction, so that the latch lever 11 is swung in the counterclockwise direction. With this, the latch 7 is swung from the half latch position to the full latch position, as shown in FIGS. 8 and 13. Then, when the full latch sensing switch 15 senses that the latch 7 is positioned at the full latch position, the motor 321 is controlled to be once stopped by the control circuit device, and then to be immediately rotated in the reverse direction.

When the motor 321 is controlled to be rotated in the reverse direction, the sector gear 39 is reversed to be rotated in the counterclockwise direction, so that the planetary gear 36 is pivoted around the sun gear 35 in the counterclockwise direction while rotating on its axis in the counterclockwise direction. The closing lever 38 is reversed to be pivoted by the urging force of the sprig 40 in the counterclockwise direction and also the pivot movement of the planetary gear 36 around the sun gear 35, and returned to the neutral position as shown in FIG. 14. Then, when the sensing switch 62 senses that the sector gear 39 is positioned at the neutral position, the motor 321 is controlled to be stopped. Consequently, the planetary gear mechanism 33 is returned to the neutral state which is a state before the actuation, so that the sequential closing operation is finished.

(Canceling Operation for Interrupting Closing Operation)

During a process from the half latch state shown in FIG. 12 to the full latch state shown in FIG. 13, when it is necessary to interrupt the closing operation for getting a foreign object caught between the door D and an entrance of the vehicle body, it is possible to avoid getting the foreign object caught by operating the outside handle OH or the inside handle IH to open the door.

That is, when the lock/unlock mechanism 101 of the operation relay device 100 is in the unlock state, the motor 321 is controlled to be stopped by the door open operation of the outside handle OH or the inside handle IH. Moreover, at the same time, the release lever 19 is actuated in the release direction as shown in FIG. 15. With this, the release portion 192 of the release input lever 19 moves the second arm portion 122 of the open lever 12 in the downward direction, so that the ratchet 9 and also the open lever 12 are actuated in the release direction. Moreover, the bending portion 193 of the release input lever 19 is abutted on the abutment portion 201 of the block lever 20, and swings the block lever 20 to the cancel position against the urging force of the spring 23.

When the block lever 20 is moved to the cancel position, the block portion 203 is moved out of the path (trajectory) of the movement of the abutment portion 352 of the sun gear 35, so as to allow the free pivot movement of the sun gear 35 in the counterclockwise direction. With this, the transmission of the reduced speed from the sector gear 39 to the planetary gear 36 is disconnected, the closing lever 38 is reversed to be pivoted to the neutral position by the urging force of the spring 40 as shown in FIG. 16. With this, the latch 7 can be swung to the open position, so that the door D can be rapidly opened. Accordingly, it is possible to avoid the risk of getting the foreign object caught between the door D and the entrance of the vehicle body, and to improve the safety.

When the open operation of the outside handle OH or the inside handle IH is stopped it is avoided to get the foreign object caught, the motor 321 is controlled to be reversed, so that the sector gear 39 is swung toward the ring gear neutral position, and so that the sun gear 35 is returned to the sun gear neutral position (for example, the positions shown in FIGS. 11 and 12) to be interlocked with the pivot movement of the planetary gear 36 around the sun gear 35 and the rotation of the planetary gear 36 on its axis by the swinging movement of the sector gear 39. Consequently, the sequential cancel operation is finished.

Moreover, when the lock/unlock mechanism 101 of the operation relay device 100 is in the lock state, the door open operation of the outside handle OH or the inside handle IH is not transmitted to the release input lever 19, and however transmitted to the emergency lever 21. Accordingly, it is possible to interrupt the closing operation, similarly to the above-described case, by the release actuation of the emergency lever 21.

(Release Operation)

When the operation switch provided to the inside of the vehicle or the wireless operation switch is operated to open the door in a case where the door D is in the fully closed state and the door latch 1 is in the full latch state shown in FIGS. 8 and 14, the motor 321 is reversed. With this, the sector gear 39 is pivoted in the release direction (in the counterclockwise direction) on the support shaft 34. On the other hand, the planetary gear 36 is supported by the closing lever 38 which is held at the neutral position, and which is inhibited from the pivot movement in the counterclockwise direction. Accordingly, the planetary gear 36 is not pivoted around the sun gear 35, and is rotated on its axis in the counterclockwise direction. The sun gear 35 is pivoted a predetermined angle in the release direction from the sun gear neutral position based on the rotation of the planetary gear 36 on its axis. With this, as shown in FIG. 17, the abutment portion 352 of the sun gear 35 is abutted on the release portion 301*a* of the output lever 301 by the pivot movement of the sun gear 35, so as to actuate the first release output lever 301 in the release direction.

When the release cancel input lever 303 is positioned at the connection position, the release actuation of the first release output lever 301 is transmitted through the floating pin 308 to the second release output lever 302. The release actuation of the second release output lever 302 is transmitted through the operation force transmitting member 503 to the handle interlocking lever 102 of the operation relay device 100. When the lock/unlock mechanism 101 of the operation relay device 100 is in the unlock state, the release actuation inputted to the handle interlocking lever 102 is transmitted through the output lever 103 and the operation force transmitting member 505 to the release input lever 19. With this, as shown in FIG. 17, the ratchet 9 performs the release actuation so as to release the engagement with the latch 7, so that the door D can be opened.

(Release Cancel Operation for Canceling Release Restriction State)

Figure 17:
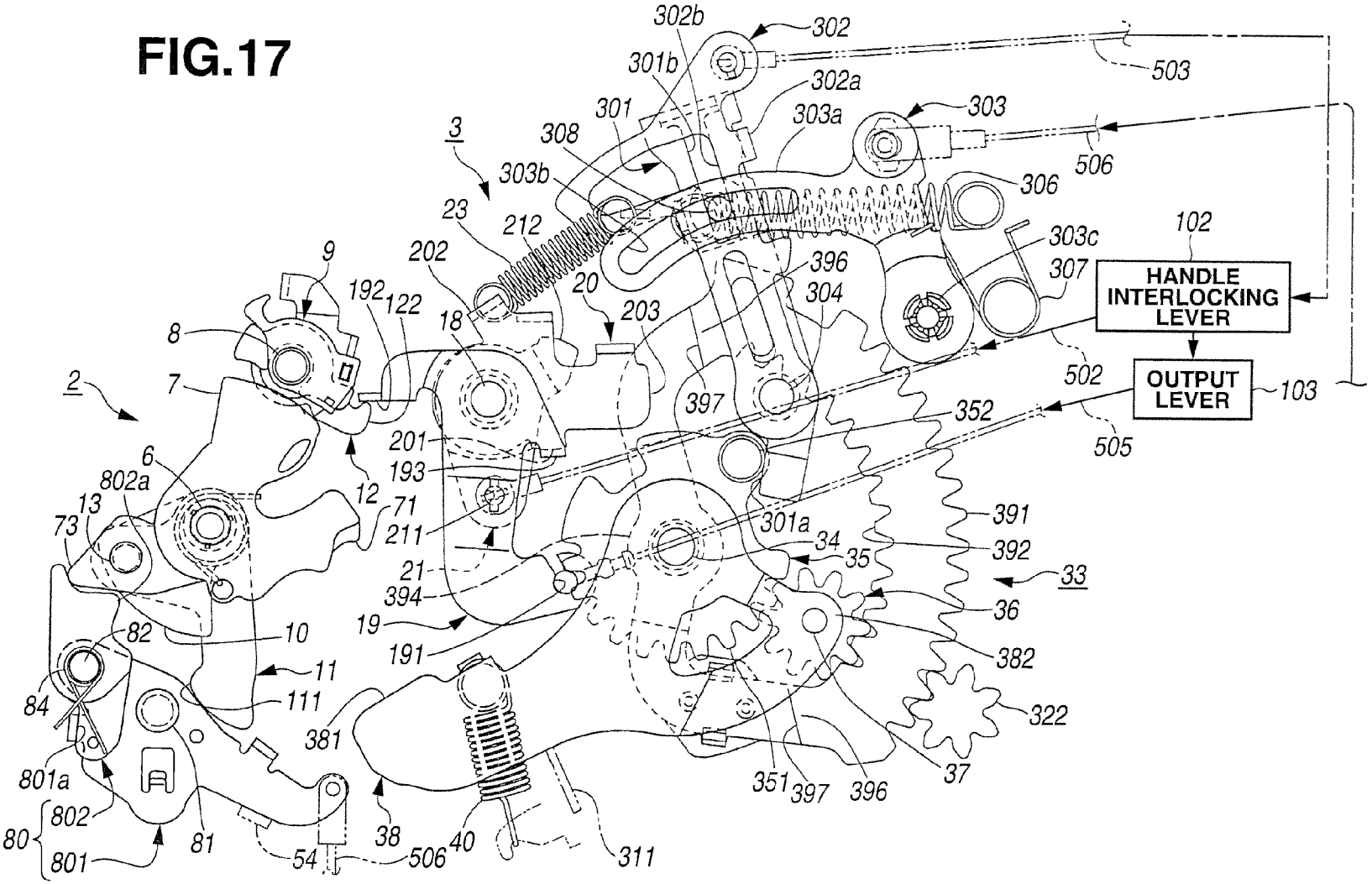
FIG. 17 is a front view showing the main portion of the door latch system in a releasing operation.

In a state where the sector gear 39 is actuated in the release direction from the ring gear neutral position as shown in FIG. 17, when the sector gear 39 is stopped at the position to which the sector gear 39 is pivoted in the release direction due to the electric failure (malfunction) or other causes and thereby the sector gear 39 cannot be returned to the ring gear neutral position, the abutment portion 352 of the sun gear 35 is continued to be abutted on the release portion 301*a* of the first release output lever 301. Accordingly, there is generated the release restriction state in which the first release output lever 301 and the second release output lever 302 are restricted at the positions at which the release actuation is performed. Consequently, even when the occupant tries to close the door D in this state, the ratchet 9 cannot to be engaged with the latch 7 since the ratchet 9 is held in the release actuation state. Therefore, it is not possible to close the door D.

However, in the door latch system according to this embodiment of the present invention, even when the release restriction state is generated, it is possible to cancel the release restriction state by the normal operation of merely closing the door D, and thereby to close the door D.

That is, in a case where the door D is closed in the release restriction state shown in FIG. 17, when the latch 7 is pivoted the predetermined angle from the open position toward the full latch position to the predetermined pivot position as shown in FIG. 6, the arm portion 73 of the latch 7 is abutted on the cam portion 802*a* of the second lever 802 of the latch interlocking mechanism 80, so that the first and second levers 801 and 802 are actuated in the release cancel direction from the neutral position against the urging force of the spring 83. This actuation in the release cancel direction is transmitted through the operation force transmitting member 506 to the release cancel input lever 303. With this, as shown in FIG. 18, the release cancel input lever 303 is moved to the disconnection position against the urging force of the spring 307. Moreover, the floating pin 308 is moved to the disconnection position which is the upper portion of the elongated hole 302*b* of the second release output lever 302 to follow the movement of the release cancel input lever 303 to the disconnection position. With this, the operation force transmitting path between the first release output lever 301 and the second release output lever 302 is disconnected, so that the second release output lever 302 can be moved to the neutral position. Accordingly, the second release output lever 302 restricted at the release actuation position can be returned to the neutral position while the first release output lever 301 is left. With this, the release input lever 19 and the open lever 12 can be returned to the neutral position, so that the ratchet 9 can be returned to the engagement position. Accordingly, the ratchet 9 can be engaged with the half latch engagement portion 72 or the full latch engagement portion 71 of the latch 7, at the half latch position or the full latch position of the latch 7, so that the door D can be closed.

Moreover, the arm portion 73 of the latch 7 is disengaged from the cam portion 802*a* of the second lever 802 after the latch 7 passes through the predetermined position, so that the latch interlocking mechanism 80 is returned to the neutral position by the urging force of the spring 83. With this, when the sector gear 39 is returned to the ring gear neutral position by recovery from the electric failure and so on, the release cancel input lever 303 is returned from the disconnection position to the connection position by the urging force of the spring 307.

As described above, it is possible to cancel the release restriction state by the normal operation of merely closing the door D. Accordingly, it is possible to constantly surely close the door D without the special operation of the occupant even when the release restriction state is generated.

Figure 19:
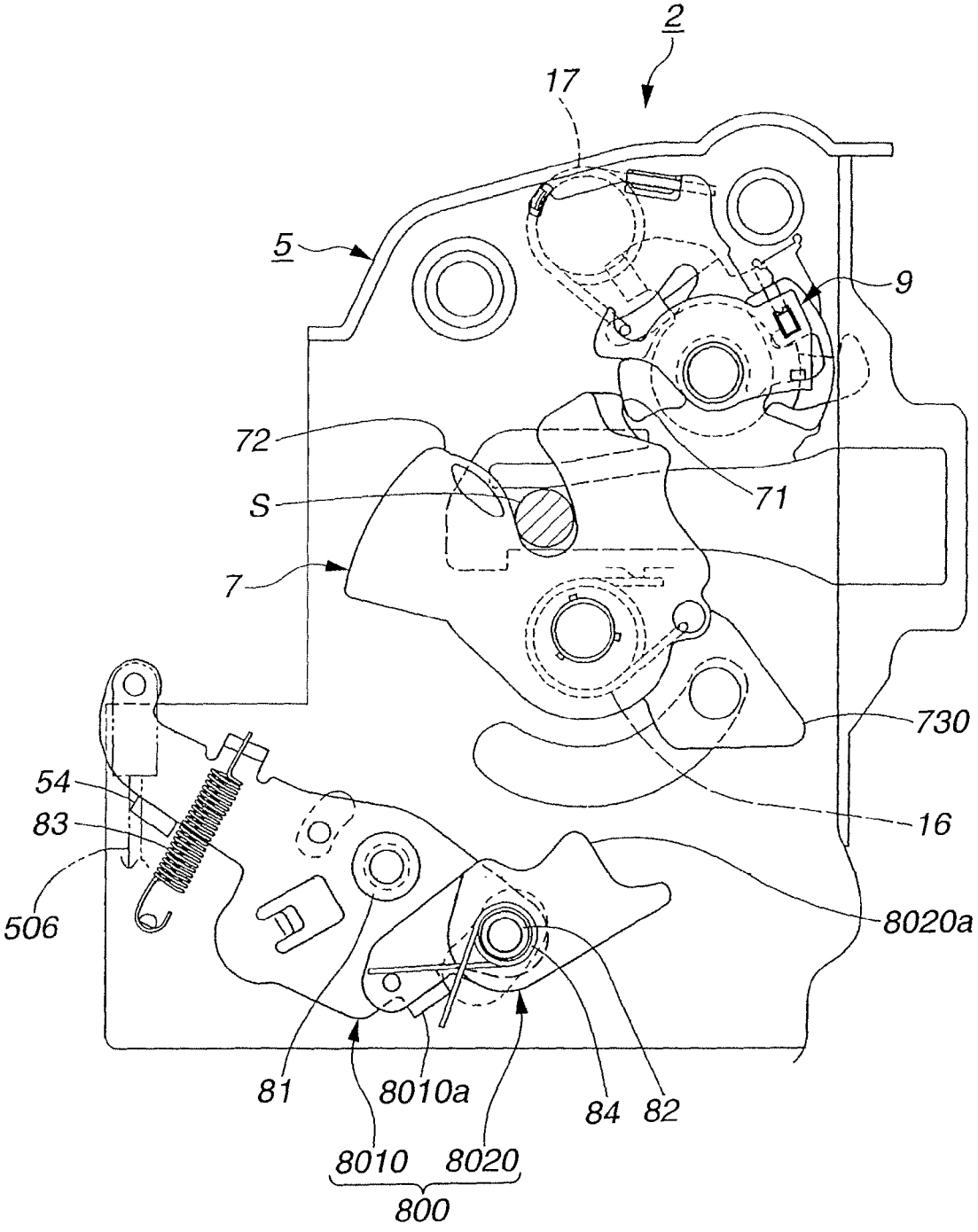
FIG. 19 is a side view showing a latch unit in a full latch state, in a door latch system according to a second embodiment of the present invention.
Figure 20:
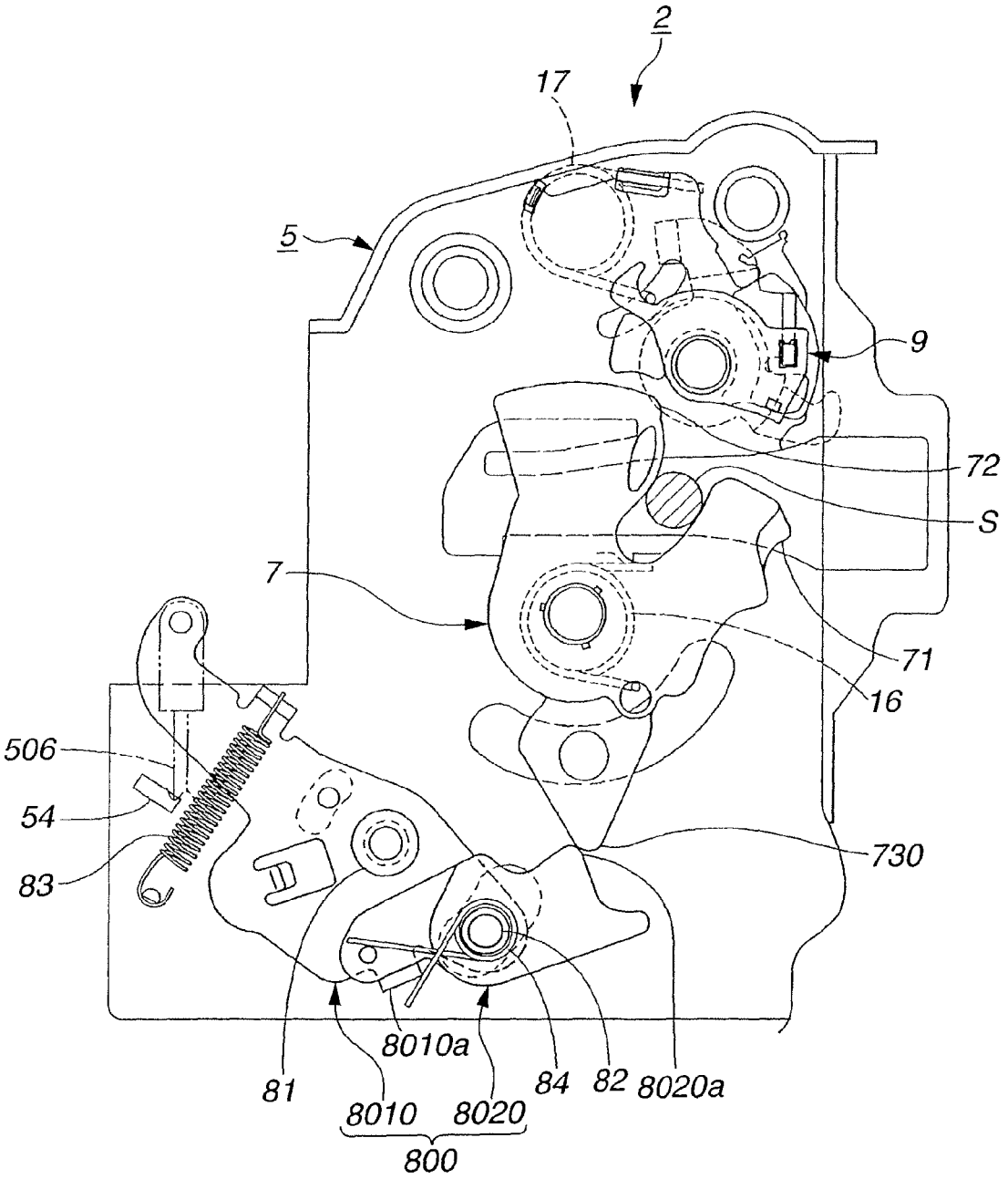
FIG. 20 is a side view showing the latch unit when the latch is pivoted a predetermined angle in an open direction from a full latch position.
Figure 21:
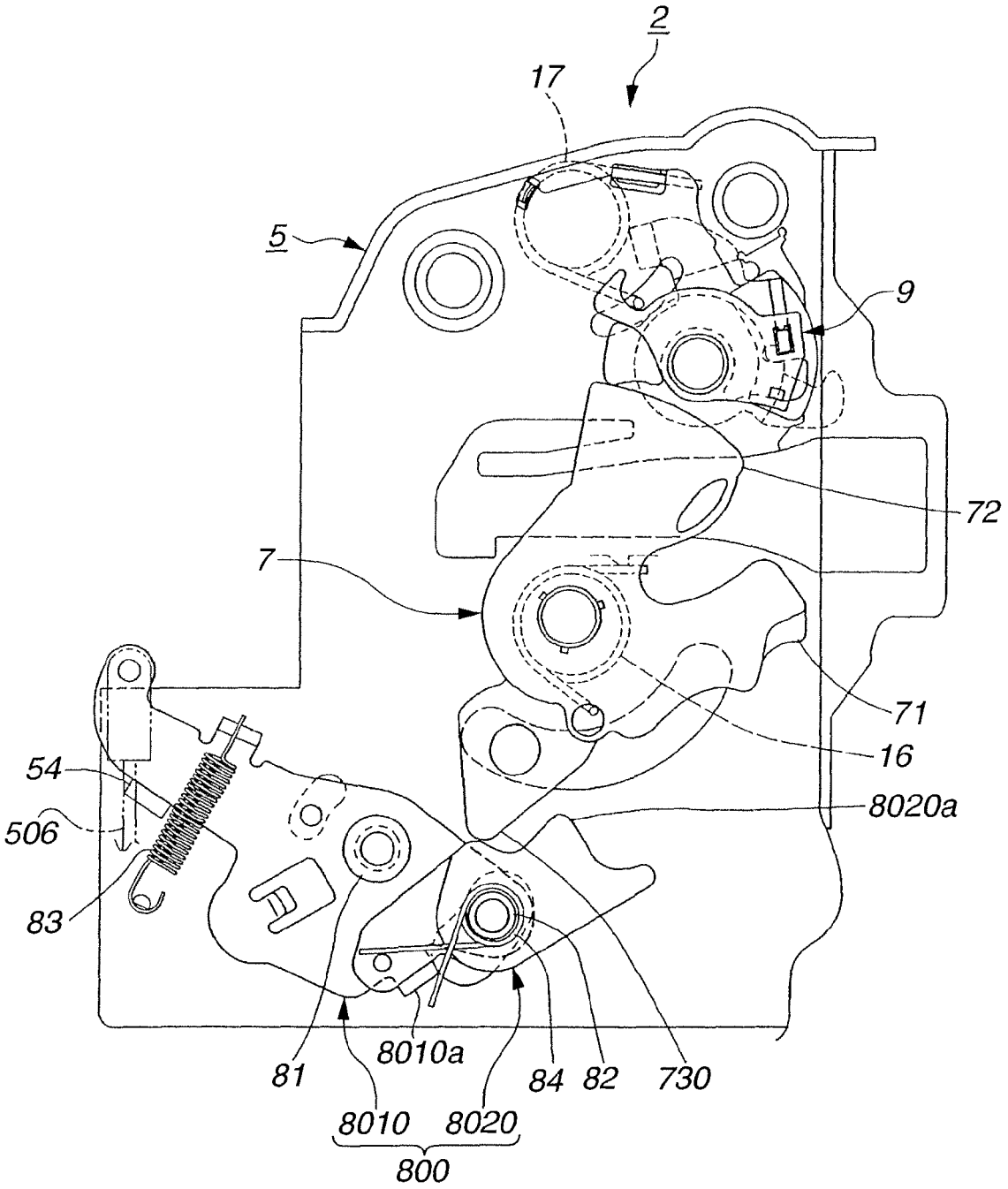
FIG. 21 is a side view showing the latch unit when the latch is pivoted from the full latch position to the open position.

FIGS. 19-21 are views showing a door latch system according to a second embodiment of the present invention.

In the door latch system according to the second embodiment of the present invention, the release restriction state is canceled by the operation when the door D is opened, that is, the operation when the latch 7 is pivoted in the open direction from the full latch position. The door latch system according to the second embodiment of the present invention is substantially identical to the door latch system according to the first embodiment of the present invention in most aspects as shown by the use of the same reference numerals or reference numerals obtained by adding 0 to the corresponding reference numerals. Accordingly, the repetitive illustrations are omitted.

Similarly to the first embodiment, a latch interlocking mechanism 800 in the second embodiment includes a first lever 8010 pivotally supported on the housing 5 by the support shaft 81; and a second lever 8020 which is pivotally supported at an end portion of the first lever 8010.

When the latch 7 is positioned at the full latch position as shown in FIG. 19, the arm portion 730 of the latch 7 is apart from a cam portion 8020*a* of a second lever 8020. The latch interlocking mechanism 800 including the first lever 8010 and the second lever 8020 is held at the neutral position. When the latch 7 is pivoted in the open direction (in the clockwise direction in FIG. 19) from the full latch position to a predetermined position (a position between the half latch position and the open position), a tip end portion of the arm portion 730 is abutted on an apex portion of the cam portion 8020*a* of the second lever 8020 as shown in FIG. 20, so that the first and second levers 8010 and 8020 are pivoted against the urging force of the spring 83 from the neutral position shown in FIG. 19 to the release cancel position shown in FIG. 20 while the second lever 8020 is continued to be abutted on a stopper portion 8010*a* of the first lever 8010. The release cancel actuation of the first lever 8010 to the release cancel position is transmitted through the operation force transmitting member 506 to the release cancel input lever 303, so that the release cancel input lever 303 is moved from the connection position to the disconnection position.

When the latch 7 passes through the predetermined position and the latch 7 is pivoted in the open direction as shown in FIG. 20, the arm portion 730 is detached from the cam portion 8020*a* of the second lever 8020, so that the first and second levers 8010 and 8020 are returned to the neutral positions by the urging force of the spring 83. With this, the release cancel input lever 303 of the release cancel mechanism can be returned to the connection position. Besides, in this structure, when the latch 7 is pivoted in the closing direction (in a direction in which the latch 7 is pivoted from the open position to the full latch position), the second lever 8020 can be pivoted in the clockwise direction against the urging force of the spring 84, so that the first and second levers 8010 and 8020 are not actuated in the release cancel direction.

As described above, in the door latch system according to the second embodiment, it is possible to cancel the release restriction state by the pivot movement in the open direction when the latch 7 is pivoted from the full latch position to the open position.

Although the invention has been described above by reference to certain embodiments of the invention, the invention is not limited to the embodiments described above. Following modifications and variations of the embodiments described above will occur to those skilled in the art within the gist of the invention. Moreover, it is optional to combine these modifications and variations.

(a) The second release output lever 302 may be directly or indirectly connected to the ratchet 9 without through the operation relay device 100.

(b) The first release output lever 301 and the second release output lever 302 are formed into an integral structure. In this case, the integral structure of the first release output lever 301 and the second release output lever 302 serves as the release output lever. Accordingly, a disconnecting portion of the operation force transmitting path which transits the power of the electric driving mechanism to the ratchet 9 is provided at a path connecting the release output lever and the ratchet 9.

(c) The latch interlocking mechanism 80 and 800 may be constituted by an integral structure of the first lever 801 and the second lever 802.

(d) The latch interlocking mechanism may be arranged to perform the release cancel operation when the latch 7 is pivoted both in the close direction and in the open direction.

(e) The latch interlocking mechanism 80 and 800 may be provided to the front door latch FD in place of providing to the door latch 1, or in addition to providing to the door latch 1. The latch interlocking mechanism 80 and 800 may be arranged to be interlocked with the pivot movement of the latch of the front door latch FD. In this case, the front door latch ED includes a latch which is arranged to be engaged with a striker of the vehicle body in the fully closed state of the door D, and a ratchet which is arranged to be engaged with the latch, similarly to the door latch 1.

(f) The latch interlocking mechanism is arranged to perform the release cancel operation to be interlocked with the actuation of the full open latch OD. In this case, the full open latch includes a latch which is arranged to be engaged with a striker of the vehicle body in the fully open state of the door D, and a ratchet which is arranged to be engaged with the latch. The latch interlocking mechanism is arranged to perform the release cancel actuation by the pivot movement in the close direction when the latch is engaged with the striker, and/or the pivot movement in the open direction when the latch is disengaged from the striker.

The door latch system according to the embodiment of the present invention includes: a latch which is provided to one of a door and a vehicle body, and which is arranged to be pivoted between a latch position at which the latch is engaged with a striker provided to the other of the door and the vehicle body when the door is at one of a door closed position and a door open position, and an open position at which the latch is released from the striker; a ratchet arranged to be moved between an engagement position at which the ratchet is engaged with the latch positioned at the latch position so as to restrict a pivot movement of the latch in an open direction, and a release position at which the ratchet is released from the latch so as to allow the pivot movement of the latch in the open direction; an electric driving mechanism arranged to output a power for moving the ratchet from the engagement position to the release position; a latch interlocking mechanism which is arranged to be actuated in a release cancel direction from a neutral position to be interlocked with the pivot movement of the latch in a predetermined direction; and a release cancel mechanism which is arranged to be actuated from a connection state where an operation force transmitting path for transmitting the power of the electric driving mechanism to the ratchet is connected, to a disconnection state where the operation force transmitting path is disconnected, by the actuation of the latch interlocking mechanism in the release cancel direction from the neutral position, the release cancel mechanism being arranged to be actuated from the connection state to the disconnection state when the ratchet is in a release restriction state where the ratchet is restricted to the release position so as to enable the ratchet to return to the engagement position.

In the door latch system according to the embodiments of the present invention, the latch interlocking mechanism includes a lever arranged to be abutted on the latch when the latch is pivoted in the predetermined direction to a predetermined position, and thereby to be actuated in the release cancel direction from the neutral position against an urging force of a spring, and arranged to return to the neutral position by the urging force of the spring when the latch is further actuated in the predetermined direction to pass through the predetermined position.

In the door latch system according to the embodiments of the present invention, the predetermined direction of the latch is a close direction when the latch is pivoted from the open position to the latch position.

In the door latch system according to the embodiments of the present invention, the predetermined direction of the latch is an open direction when the latch is pivoted from the latch position to the open position.

In the door latch system according to the embodiments of the present invention, the predetermined direction of the latch is a close direction when the latch is pivoted from an open position to the latch position, and the open direction when the latch is pivoted from the latch position to the open position.

In the door latch system according to the embodiments of the present invention, the lever of the latch interlocking mechanism is not actuated in the release cancel direction when the latch is pivoted in an open direction from the latch position to the open position.

In the door latch system according to the embodiment of the present invention, the lever of the latch interlocking mechanism is not actuated in the release cancel direction when the latch is pivoted in a close direction from the open position to the latch position.

In the door latch system according to the embodiments of the present invention, the predetermined position of the latch is between the open position and the latch position.

In the door latch system according to the embodiments of the present invention, the release cancel mechanism includes a release output lever which is arranged to be abutted on a rotation member constituting a part of the electric driving mechanism based on the actuation of the electric driving mechanism, and thereby to be actuated in a release direction to actuate the ratchet to the release position, and a release cancel input lever arranged to be moved from a connection position at which the operation force transmitting path is brought to a connection state, to a disconnection state at which the operation force transmitting path is brought to a disconnection state, to be interlocked with the actuation of the latch interlocking mechanism in the release cancel direction when the release output lever is actuated in the release direction.

In the door latch system according to the embodiments of the present invention, the release output lever includes a first release output lever which is arranged to be abutted on the rotation member of the electric driving mechanism, and thereby to be actuated in the release direction, and a second release output lever which is directly or indirectly connected to the ratchet, and to be actuated with the first release output lever in the release direction when the release cancel input lever is in the connection position; and the release cancel input lever connects the operation force transmitting path between the first release output lever and the second release output lever when the release cancel input lever is positioned at the connection position, and disconnects the operation force transmitting path when the release cancel input lever is positioned at the disconnection position.

In the door latch system according to the embodiments of the present invention, the release cancel input lever is arranged to return from the disconnection position to the connection position when the lever of the latch interlocking mechanism is returned to the neutral position from the position to which the lever of the latch interlocking mechanism is actuated in the release cancel direction.

In the door latch system according to the embodiments of the present invention, it is possible to release the release restriction state only by the door open operation or the door closing operation. Accordingly, it is possible to release the release restriction state without forcing the special operation to the occupant so as to close the door.

The entire contents of Japanese Patent Application No. 2012-201108 filed Sep. 13, 2012 and Japanese Patent Application No. 2012-263206 filed Nov. 30, 2012 are incorporated herein by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A door latch system for a vehicle comprising:

a latch which is provided to one of a door and a vehicle body, and which is arranged to be pivoted between a latch position at which the latch is engaged with a striker provided to the other of the door and the vehicle body when the door is at one of a door closed position and a door open position, and an open position at which the latch is released from the striker;

a ratchet arranged to be moved between an engagement position at which the ratchet is engaged with the latch positioned at the latch position so as to restrict a pivot movement of the latch in an open direction, and a release position at which the ratchet is released from the latch so as to allow the pivot movement of the latch in the open direction;

an electric driving mechanism arranged to output a power for moving the ratchet from the engagement position to the release position;

a latch interlocking mechanism which is arranged to be actuated in a release cancel direction from a neutral position and to be interlocked with the pivot movement of the latch in a close direction when the latch is pivoted from the open position to the latch position; and a release cancel mechanism which is arranged to be actuated from a connection state where an operation force transmitting path for transmitting the power of the electric driving mechanism to the ratchet is connected, to a disconnection state where the operation force transmitting path is disconnected, by the actuation of the latch interlocking mechanism in the release cancel direction from the neutral position, the release cancel mechanism being arranged to be actuated from the connection state to the disconnection state when the ratchet is in a release restriction state where the ratchet is restricted to the release position so as to enable the ratchet to return to the engagement position.

2. The door latch system as claimed in claim 1, wherein the latch interlocking mechanism includes a lever arranged to be abutted on the latch when the latch is pivoted in the close direction to a predetermined position, and thereby to be actuated in the release cancel direction from the neutral position against an urging force of a spring, and arranged to return to the neutral position by the urging force of the spring when the latch is further actuated in the close direction to pass through the predetermined position.

3. The door latch system as claimed in claim 2, wherein the latch interlocking mechanism is further arranged to be interlocked with the pivot movement of the latch in the open direction when the latch is pivoted from the latch position to the open position.

4. The door latch system as claimed in claim 2, wherein the lever of the latch interlocking mechanism is not actuated in the release cancel direction when the latch is pivoted in the open direction from the latch position to the open position.

5. The door latch system as claimed in claim 2, wherein the predetermined position of the latch is between the open position and the latch position.

6. The door latch system as claimed in claim 1, wherein the release cancel mechanism includes a release output lever which is arranged to be abutted on a rotation member constituting a part of the electric driving mechanism based on the actuation of the electric driving mechanism, and thereby to be actuated in a release direction to actuate the ratchet to the release position, and a release cancel input lever arranged to be moved from a connection position at which the operation force transmitting path is brought to a connection state, to a disconnection state at which the operation force transmitting path is brought to a disconnection state, to be interlocked with the actuation of the latch interlocking mechanism in the release cancel direction when the release output lever is actuated in the release direction.

7. The door latch system as claimed in claim 6, wherein the release output lever includes a first release output lever which is arranged to be abutted on the rotation member of the electric driving mechanism, and thereby to be actuated in the release direction, and a second release output lever which is directly or indirectly connected to the ratchet, and to be actuated with the first release output lever in the release direction when the release cancel input lever is in the connection position; and the release cancel input lever connects the operation force transmitting path between the first release output lever and the second release output lever when the release cancel input lever is positioned at the connection position, and disconnects the operation force transmitting path when the release cancel input lever is positioned at the disconnection position.

8. The door latch system as claimed in claim 6, wherein the release cancel input lever is arranged to return from the disconnection position to the connection position when the lever of the latch interlocking mechanism is returned to the neutral position from the position to which the lever of the latch interlocking mechanism is actuated in the release cancel direction.

9. A door latch system for a vehicle comprising:

a latch which is provided to one of a door and a vehicle body, and which is arranged to be pivoted between a latch position at which the latch is engaged with a striker provided to the other of the door and the vehicle body when the door is at one of a door closed position and a door open position, and an open position at which the latch is released from the striker;

a ratchet arranged to be moved between an engagement position at which the ratchet is engaged with the latch positioned at the latch position so as to restrict a pivot movement of the latch in an open direction, and a release position at which the ratchet is released from the latch so as to allow the pivot movement of the latch in the open direction;

an electric driving mechanism arranged to output a power for moving the ratchet from the engagement position to the release position;

a latch interlocking mechanism which is arranged to be actuated in a release cancel direction from a neutral position and to be interlocked with the pivot movement of the latch in the open direction when the latch is pivoted from the latch position to the open position; and a release cancel mechanism which is arranged to be actuated from a connection state where an operation force transmitting path for transmitting the power of the electric driving mechanism to the ratchet is connected, to a disconnection state where the operation force transmitting path is disconnected, by the actuation of the latch interlocking mechanism in the release cancel direction from the neutral position, the release cancel mechanism being arranged to be actuated from the connection state to the disconnection state when the ratchet is in a release restriction state where the ratchet is restricted to the release position so as to enable the ratchet to return to the engagement position.

10. The door latch system as claimed in claim 9, wherein the latch interlocking mechanism includes a lever arranged to be abutted on the latch when the latch is pivoted in the open direction to a predetermined position, and thereby to be actuated in the release cancel direction from the neutral position against an urging force of a spring, and arranged to return to the neutral position by the urging force of the spring when the latch is further actuated in the open direction to pass through the predetermined position.

11. The door latch system as claimed in claim 10, wherein the latch interlocking mechanism is further arranged to be interlocked with a pivot movement of the latch in a close direction when the latch is pivoted from the open position to the latch position.

12. The door latch system as claimed in claim 10, wherein the lever of the latch interlocking mechanism is not actuated in the release cancel direction when the latch is pivoted in a close direction from the open position to the latch position.

13. The door latch system as claimed in claim 10, wherein the predetermined position of the latch is between the open position and the latch position.

14. The door latch system as claimed in claim 9, wherein the release cancel mechanism includes a release output lever which is arranged to be abutted on a rotation member constituting a part of the electric driving mechanism based on the actuation of the electric driving mechanism, and thereby to be actuated in a release direction to actuate the ratchet to the release position, and a release cancel input lever arranged to be moved from a connection position at which the operation force transmitting path is brought to a connection state, to a disconnection state at which the operation force transmitting path is brought to a disconnection state, to be interlocked with the actuation of the latch interlocking mechanism in the release cancel direction when the release output lever is actuated in the release direction.

15. The door latch system as claimed in claim 14, wherein the release output lever includes a first release output lever which is arranged to be abutted on the rotation member of the electric driving mechanism, and thereby to be actuated in the release direction, and a second release output lever which is directly or indirectly connected to the ratchet, and to be actuated with the first release output lever in the release direction when the release cancel input lever is in the connection position; and the release cancel input lever connects the operation force transmitting path between the first release output lever and the second release output lever when the release cancel input lever is positioned at the connection position, and disconnects the operation force transmitting path when the release cancel input lever is positioned at the disconnection position.

16. The door latch system as claimed in claim 14, wherein the release cancel input lever is arranged to return from the disconnection position to the connection position when the lever of the latch interlocking mechanism is returned to the neutral position from the position to which the lever of the latch interlocking mechanism is actuated in the release cancel direction.

* * * * *